US009574329B2

(12) United States Patent
Wu

(10) Patent No.: US 9,574,329 B2
(45) Date of Patent: Feb. 21, 2017

(54) SHOVEL AND METHOD OF CONTROLLING SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 322 days.

(21) Appl. No.: 14/197,305

(22) Filed: Mar. 5, 2014

(65) Prior Publication Data

US 2014/0182279 A1 Jul. 3, 2014

Related U.S. Application Data

(63) Continuation of application No. PCT/JP2012/072818, filed on Sep. 6, 2012.

(30) Foreign Application Priority Data

Sep. 9, 2011 (JP) ..... 2011-197672
Sep. 12, 2011 (JP) ..... 2011-198889

(51) Int. Cl.
*E02F 9/22* (2006.01)
*E02F 9/20* (2006.01)
*F15B 21/14* (2006.01)

(52) U.S. Cl.
CPC ..... *E02F 9/2264* (2013.01); *E02F 9/2075* (2013.01); *E02F 9/2091* (2013.01);
(Continued)

(58) Field of Classification Search
CPC ..... F15B 11/024; F15B 21/14; F15B 2211/30595
(Continued)

(56) References Cited

U.S. PATENT DOCUMENTS 6,151,894 A * 11/2000 Endo ..... E02F 9/2207 60/414
7,775,040 B2 * 8/2010 Khalil ..... F15B 11/024 60/414
(Continued)

FOREIGN PATENT DOCUMENTS

JP 56006901 A * 1/1981 ..... F15B 11/16
JP 2006-336848 12/2006
(Continued)

OTHER PUBLICATIONS

International Search Report mailed on Dec. 18, 2012.

*Primary Examiner* — Nathaniel Wiehe
*Assistant Examiner* — Matthew Wiblin
(74) *Attorney, Agent, or Firm* — IPUSA, PLLC

(57) ABSTRACT

A shovel includes a plurality of hydraulic actuators including a first hydraulic actuator and a second hydraulic actuator, a main pump, a hydraulic pump-motor configured to function as a hydraulic motor by using hydraulic oil flowing out of the first hydraulic actuator and configured to function as a hydraulic pump, a control valve configured to control a flow of the hydraulic oil in the plurality of hydraulic actuators, a first oil passage to connect the main pump with the second hydraulic actuator through the control valve, and a second oil passage to connect the hydraulic pump-motor with the second hydraulic actuator. The second oil passage meets the first oil passage between the control valve and the second actuator.

18 Claims, 15 Drawing Sheets

(52) U.S. Cl.
CPC ..... *E02F 9/2217* (2013.01); *E02F 9/2285* (2013.01); *E02F 9/2296* (2013.01); *F15B 21/14* (2013.01); *F15B 2211/20515* (2013.01); *F15B 2211/20546* (2013.01); *F15B 2211/20569* (2013.01); *F15B 2211/20576* (2013.01); *F15B 2211/30595* (2013.01); *F15B 2211/3116* (2013.01); *F15B 2211/7053* (2013.01); *F15B 2211/7142* (2013.01); *F15B 2211/761* (2013.01); *F15B 2211/88* (2013.01)

(58) Field of Classification Search
USPC ..... 60/414, 484, 486
See application file for complete search history.

(56) References Cited

U.S. PATENT DOCUMENTS

| | | | | |
|---|---|---|---|---|
| 8,726,645 | B2 * | 5/2014 | Shang | E02F 9/123 60/414 |
| 2004/0035103 | A1 * | 2/2004 | Nagura | F15B 1/024 60/414 |
| 2005/0246082 | A1 * | 11/2005 | Miki | E02F 9/2075 701/50 |
| 2007/0166168 | A1 * | 7/2007 | Vigholm | E02F 9/2207 417/20 |
| 2009/0077837 | A1 | 3/2009 | Tozawa et al. | |
| 2009/0165450 | A1 | 7/2009 | Cherney et al. | |
| 2009/0288408 | A1 | 11/2009 | Tozawa et al. | |
| 2010/0268410 | A1 * | 10/2010 | Vigholm | E02F 9/2203 701/31.4 |
| 2011/0289907 | A1 * | 12/2011 | Sugiyama | B60K 6/46 60/325 |
| 2012/0067432 | A1 * | 3/2012 | Vigholm | E02F 9/2217 137/14 |

FOREIGN PATENT DOCUMENTS

| | | |
|---|---|---|
| JP | 2006-349092 | 12/2006 |
| JP | 2008-045575 | 2/2008 |
| JP | 2008-202343 | 9/2008 |
| JP | 2010-048343 | 3/2010 |

* cited by examiner

SHOVEL AND METHOD OF CONTROLLING SHOVEL

RELATED APPLICATIONS

This patent application is a continuation of International Patent Application No. PCT/JP2012/072818, filed on Sep. 6, 2012, which is based upon and claims the benefit of priority of Japanese Patent Application No. 2011-197672, filed on Sep. 9, 2011, Japanese Patent Application No. 2011-198889, filed on Sep. 12, 2011, the entire content of each of which is incorporated herein by reference.

BACKGROUND

1. Field of the Invention

The present invention relates to a shovel including a hydraulic motor for boom regeneration and a method of controlling a shovel.

2. Description of the Related Art

A hybrid type shovel is known that includes a motor generator rotatively driven by a hydraulic motor for regeneration when a boom is lowered or an arm is closed.

The hybrid type shovel rotates the hydraulic motor for regeneration by using hydraulic oil flowing out of a bottom side oil chamber of a boom cylinder when the boom is lowered, or hydraulic oil flowing out of a rod side oil chamber of an arm cylinder when the arm is closed. As a result, the hybrid type shovel recovers positional energy of the boom or the arm as electrical energy by working the motor generator coupled with the hydraulic motor for regeneration as a generator.

SUMMARY OF THE INVENTION

According to an aspect of the present invention, there is provided a shovel that includes a plurality of hydraulic actuators including a first hydraulic actuator and a second hydraulic actuator, a main pump, a hydraulic pump-motor configured to function, as a hydraulic motor by using hydraulic oil flowing out of the first hydraulic actuator and configured to function as a hydraulic pump, a control valve configured to control a flow of the hydraulic oil in the plurality of hydraulic actuators, a first oil passage to connect the main pump with the second hydraulic actuator through the control valve, and a second oil passage to connect the hydraulic pump-motor with the second hydraulic actuator. The second oil passage meets the first oil passage between the control valve and the second actuator.

According to another aspect of the present invention, there is provided a method of controlling a shovel. The shovel includes a plurality of hydraulic actuators including a first hydraulic actuator and a second hydraulic actuator, a main pump, a hydraulic pump-motor configured to function as a hydraulic motor by using hydraulic oil flowing out of the first hydraulic actuator and configured to function as a hydraulic pump, a control valve configured to control a flow of the hydraulic oil in the plurality of hydraulic actuators, a first oil passage to connect the main pump with the second hydraulic actuator through the control valve, and a second oil passage to connect the hydraulic pump-motor with the second hydraulic actuator. In the method, the hydraulic oil flowing through the second oil passage is caused to merge into the hydraulic oil flowing through the first oil passage between the control valve and the second actuator.

DETAILED DESCRIPTION OF THE PREFERRED EMBODIMENTS

The above-mentioned hybrid type shovel cannot make full use of the hydraulic motor for regeneration because the hybrid type shovel causes the motor generator coupled to the hydraulic motor for regeneration to function only as a generator and does not include a hydraulic circuit to cause the motor generator to efficiently function as an electric motor.

In embodiments of the present invention, there is provided a shovel and a method of controlling the shovel that can make better use of the hydraulic motor for regeneration.

A description is given below, with reference to drawings of embodiments of the present invention.

Figure 1:
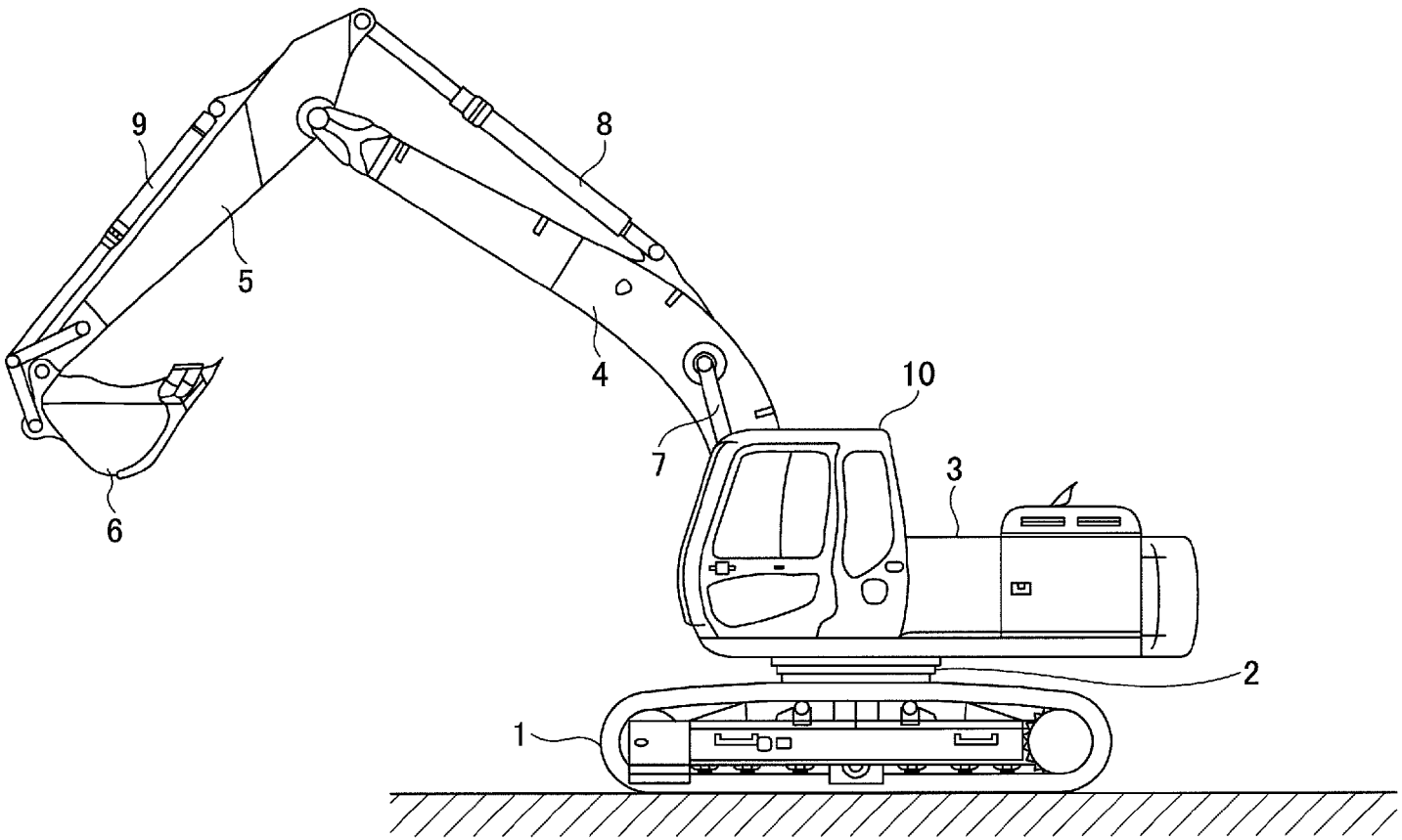
FIG. 1 is a side view of a hybrid type shovel according to an embodiment of the present invention.

FIG. 1 is a side view illustrating a hybrid type shovel to which an embodiment of the present invention is applied.

A revolving super structure 3 is mounted on a base carrier 1 of the hybrid type shovel through a swivel mechanism 2. A boom 4 is installed on the revolving super structure 3. An arm 5 is attached to the tip of the boom 4, and a bucket 6 is attached to the tip of the arm 5. The boom 4, the arm 5 and the bucket 6 are work elements that are hydraulically driven by a boom cylinder 7, an arm cylinder 8 and a bucket cylinder 9, respectively. The revolving super structure 3 includes a cabin 10, and a power source such as an engine is mounted on the revolving super structure 3.

Figure 2:
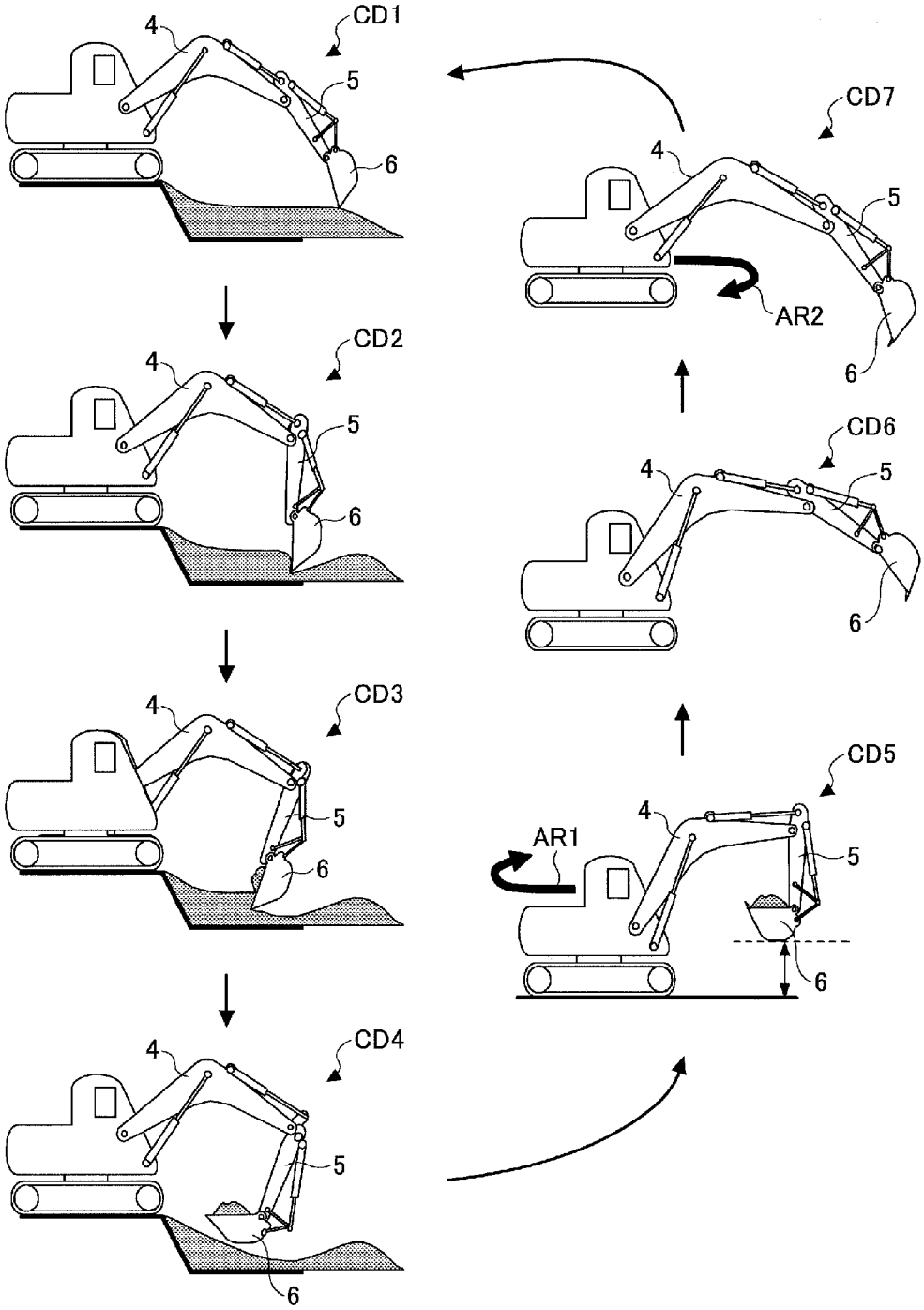
FIG. 2 is a drawing illustrating a transition of an operating state of a hybrid type shovel according to an embodiment of the present invention.

Next, referring to FIG. 2, a description is given below of an excavation and loading operation that is an example of the operation of the hybrid type shovel according to an embodiment of the present invention. To begin with, as illustrated in a state CD1, an operator-swivels the revolving super structure 3 so that the bucket 6 is positioned above an excavation position, lowers the boom 4 in a state of opening the arm 5 and the bucket 6, and then lowers the bucket 6 so that the tip of the bucket 6 becomes an intended height from an excavation object. Usually, the operator confirms the position of the bucket 6 by visual recognition when swiveling the revolving super structure 3 and lowering the boom 4. Moreover, in general, swiveling the revolving super structure 3 and lowering the boom 4 are performed at the same time. The above-mentioned operation is called a boom lowering and swiveling operation, and this operation interval is called a boom lowering and swiveling operation interval.

When the operator determines that the tip of the bucket 6 reaches the intended height, as illustrated in a state CD2, the operator operates the shovel so as to close the arm 5 until the arm 5 becomes approximately vertical to the ground. By doing this, a predetermined depth of earth is excavated, and the earth is gathered up by the bucket 6 until the arm 5 becomes approximately vertical to the surface of the ground. Next, as illustrated in a state CD3, the operator operates the shovel further to close the arm 5 and the bucket 6, and as illustrated in state CD4, operates the shovel to close the bucket 6 until the bucket 6 becomes approximately vertical to the arm 5. In other words, the bucket 6 is closed until the top end of the bucket 6 becomes approximately horizontal, and the gathered earth is picked up in the bucket 6. The above-mentioned operation is called an excavation operation, and this operation, interval is called an excavation operation interval.

Subsequently, when the operator determines that the bucket 6 is closed until the bucket 6 becomes approximately vertical to the arm 5, as illustrated in a state CBS, the operator operates the shovel so as to lift the boom 4 until the bottom of the bucket 6 becomes an intended height from the ground while closing the bucket 6. This operation is called a boom lifting operation, and this operation interval is called a boom lifting interval. Following this operation, or at the same time, the operator swivels the revolving super structure 3, and rotatively moves the bucket 6 to an earth removal position as shown by an arrow AR1. This operation including the boom lifting operation is called a boom lifting and swiveling operation, and this operation interval is called a boom lifting and swiveling operation interval.

Here, the boom 4 is lifted until the bottom of the bucket 6 reaches the intended height because, for example, when the earth is accumulated on the bed of a dump truck, the bucket 6 bumps into the bed if the bucket 6 is not lifted to the intended height.

Next, when the operator determines that the boom lifting and swiveling operation is completed, as illustrated in a state CD6, the operator operates the shovel so as to open the arm 5 and the bucket 6 while lowering or stopping the boom 4, and discharges the earth in the bucket 6. This operation is called a dumping operation, and this operation interval is called a dumping operation interval.

Subsequently, when the operator determines that the dumping operation is finished, as illustrated in a state CD7, the operator swivels the revolving super structure 3 in a direction of an arrow AR2, and moves the bucket 6 to a position right above the excavation position. At this time, the boom 4 is lowered simultaneously with the revolution, and the bucket 6 is lowered to the intended height from the excavation object. This operation is apart of the boom lowering and swiveling operation described in the state CD1. After that, as illustrated in the state CD1, the operator lowers the bucket 6 to the intended height, and performs the operation after the excavation operation again.

The above-mentioned "boom lowering and swiveling operation", "excavation operation", "boom lifting and swiveling operation" and "dumping operation" are done in one cycle, and the operator advances the excavation and loading by repeating this cycle.

First Embodiment

Figure 3:
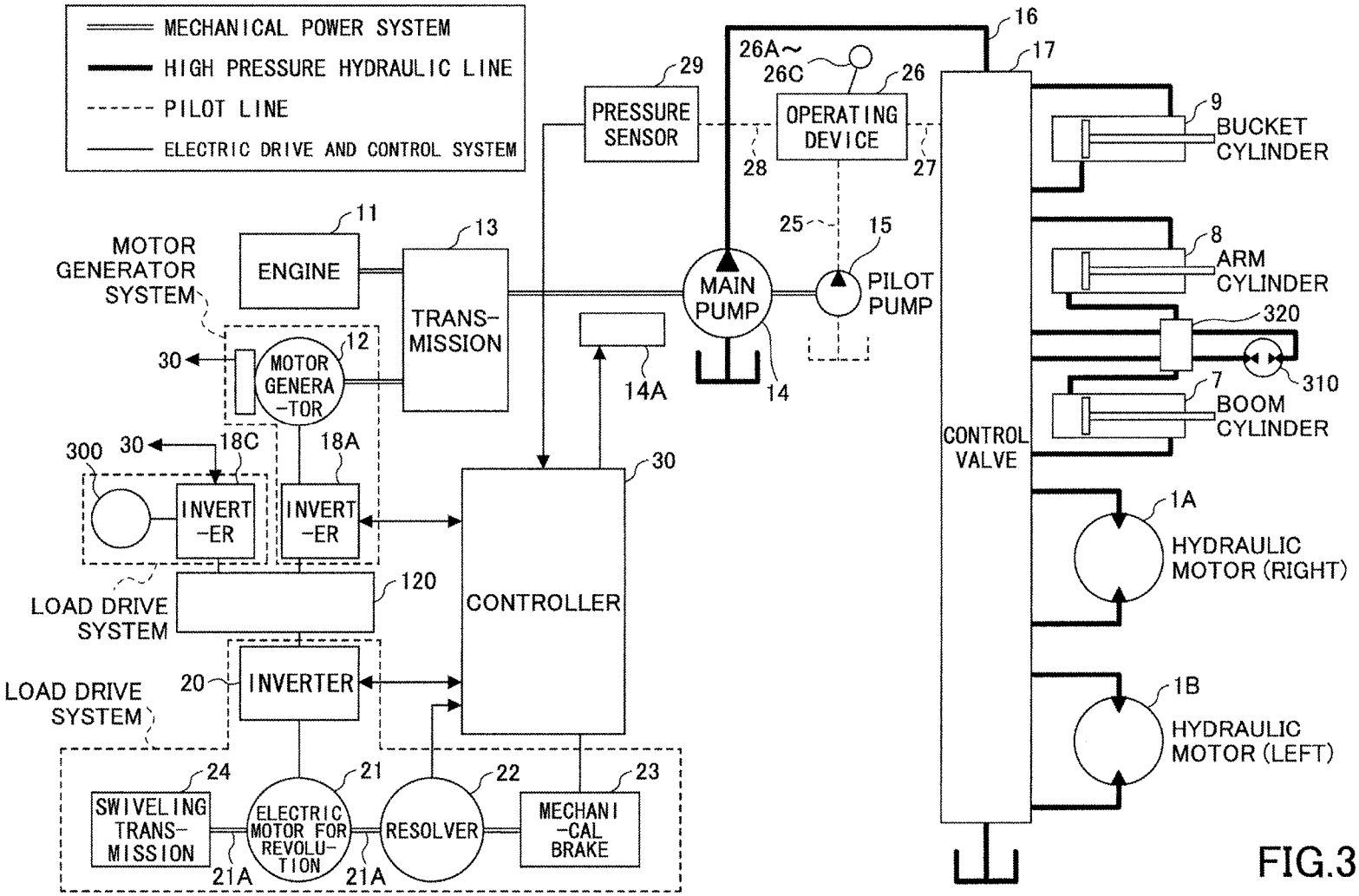
FIG. 3 is a block diagram illustrating a configuration example of a drive system of a hybrid type shovel according to an embodiment of the present invention.

FIG. 3 is a block diagram illustrating a configuration of a drive system of a hybrid type shovel according to a first embodiment of the present invention. FIG. 3 expresses a mechanical power system by a double line, a high pressure hydraulic line by a solid line (thick line), a pilot line by a dashed line, and an electric drive and control system by a solid line (thin line), respectively.

An engine 11 functioning as a mechanical type drive part and a motor generator 12 functioning as an assisting drive part are respectively connected to two input axes of a transmission 13. A main pump 14 and a pilot pump 15 are connected to an output axis of the transmission 13 as hydraulic pumps. A control valve 17 is connected to the main pump 14 through a high pressure hydraulic line 16.

A regulator 14A is a device configured to control a discharge rate of the main pump 14. For example, the discharge rate of the main pump 14 is controlled by adjusting a swash plate inclination angle in response to a discharge pressure of the main pump 14, a control, signal from a controller 30 and the like.

The control valve 17 is a control device that controls a hydraulic system in the hybrid type shovel. Hydraulic motors 1A (for the right) and 1B (for the left) for the base carrier 1, a boom cylinder 7, an arm cylinder 8 and a bucket cylinder 9 are connected to the control valve 17 through the high pressure hydraulic lines 16. Hereinafter, the hydraulic motors 1A (for the right) and 1B (for the left) for the base carrier 1, the boom cylinder 7, the arm cylinder 8 and the bucket cylinder 9 are collectively called a hydraulic actuator.

An electrical storage system 120 including a capacitor is connected to the motor generator 12 through an inverter 18A. An electric motor for revolution 21 is connected to the electrical storage system 120 through an inverter 20 as an electric work element. A resolver 22, a mechanical brake 23, and a swiveling transmission 24 are connected to a rotational axis 21A of the electric motor for revolution 21. In addition, an operating device 26 is connected to the pilot pump 15 through the pilot line 25. The electric motor for revolution 21, the inverter 20, the resolver 22, the mechanical brake 23 and the transmission for revolution 24 constitute a first load drive system.

The operating device 26 includes a lever 26A, a lever 26B and a pedal 26C. The lever 26A, the lever 26B, and the pedal 26C are connected to the control valve 17 and a pressure sensor 29 through hydraulic lines 27 and 28, respectively. The pressure sensor 29 functions as a working state detection part that detects a working state of each of the hydraulic actuators, and is connected to the controller 30 that performs drive control of the electrical system.

Moreover, in the first embodiment, a motor generator for boom regeneration 300 is connected to the electric storage system 120 through the inverter 18C. The motor generator 300 is driven as a generator by a hydraulic pump-motor 310 driven by hydraulic oil that flows from the boom cylinder 7. The motor generator 300 converts positional energy of the boom 4 (hydraulic energy of the hydraulic oil from the boom cylinder 7) into electrical energy by utilizing a pressure of the hydraulic oil flowing out of the boom cylinder 7 when the boom 4 comes down by its own weight. Here in FIG. 3, the hydraulic pump-motor 310 and the motor generator 300 are shown at positions separated from each other for convenience of explanation, but in fact, the rotational axis of the motor generator 300 is mechanically coupled to the rotational axis of the hydraulic pump-motor 310. More specifically, the hydraulic pump-motor 310 is configured to revolve by the hydraulic oil that flows out of the boom cylinder 7 when the boom 4 comes down, and is provided to convert the hydraulic energy of the hydraulic oil when the boom 4 comes down by its own weight into a turning force.

The electrical power generated by the motor generator 300 is supplied to the electrical storage system 120 through the inverter 18C as regenerative electrical power. The motor generator 300 and the inverter 18C constitute a second load drive system.

A fluid communication circuit 320 is a hydraulic circuit to fulfill a function of the hydraulic pump-motor 310 by switching between a hydraulic pump and a hydraulic motor. For example, the fluid communication circuit 320 operates the hydraulic pump-motor 310 as the hydraulic motor for boom regeneration by supplying all or a part of the hydraulic oil that flows out of the boom cylinder 7 in response to a control signal from the controller 30. Furthermore, the fluid communication circuit 320 supplies the hydraulic oil discharged from the hydraulic pump-motor 310 driven as the hydraulic pump by the motor generator 300 to the boom cylinder 7 or the arm cylinder 8 according to a control signal from the controller 30. A description is given later of operation of the fluid communication circuit 320.

Figure 4:
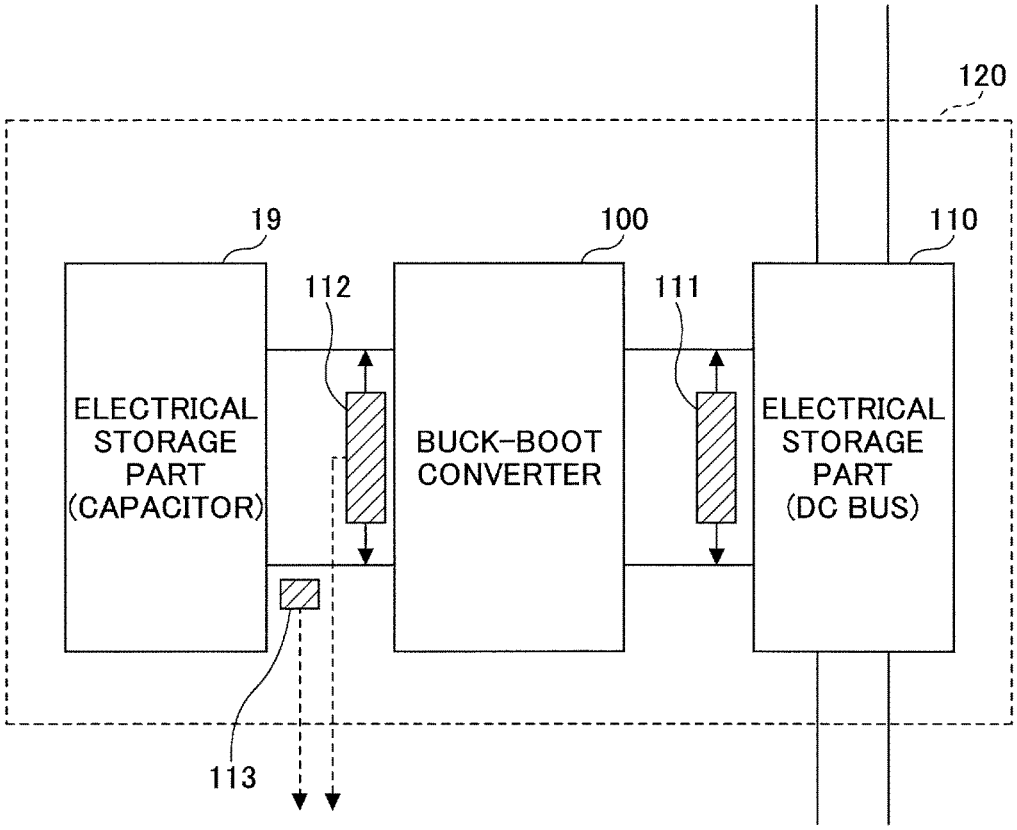
FIG. 4 is a block diagram illustrating a configuration example of an electrical storage system of a hybrid type shovel according to an embodiment of the present invention.

FIG. 4 is a block diagram illustrating a configuration of the electrical storage system 120. The electrical storage system 120 includes a capacitor 19, a buck-boost converter 100 and a DC bus 110. The capacitor 19 is provided with a capacitor voltage detection part 112 to detect a capacitor voltage value, and a capacitor current detection part 113 to detect a capacitor current value. The capacitor voltage value and the capacitor current value detected by the capacitor voltage detection part 112 and the capacitor current detection part 113 are provided for the controller 30.

The buck-boost converter 100 controls a switch of a boost operation and a step-down operation so that a DC bus voltage value falls in a predetermined range depending on operation states of the motor generator 12, the electric motor for revolution 21 and the motor generator 300. The DC bus 110 is provided between the inverters 18A, 18C and 20, and the buck-boost converter 100, and transfers the electrical power among the capacitor 19, the motor generator 12, the electric motor for revolution 21, and the motor generator 300 (see also FIG. 3).

Here, a description is given below of details of the controller 30 with reference to FIG. 3 again. The controller 30 is a control device that functions as a main control part that performs the drive control of the hybrid type shovel. The controller 30 is constituted of an arithmetic processing unit containing a CPU (Central Processing Unit) and an internal memory, and is a unit configured to function by causing the CPU to run a program for the drive control stored in the internal memory.

The controller 30 converts a signal provided from the pressure sensor 29 into a swing speed instruction, and performs the drive control of the electric motor for revolution 21. In this case, the signal provided from the pressure sensor 29 corresponds to a signal indicating a manipulated variable when the operating device 26 (i.e., swiveling control lever) is operated to swivel the swivel mechanism 2.

In addition, the controller 30 performs operation control of the motor generator 12 (switch of an electric-powered (assisting) operation or a power-generating operation), and charge and discharge control of the capacitor 19 by controlling the drive of the buck-boost converter 100 as a step-up/down control part. More specifically, the controller 30 performs the switching control of the boost operation and the step-down operation of the buck-boost converter 100 based on a state of charge of the capacitor 19, an operational state of the motor generator 12 (electric-powered (assisting) operation or power-generating operation), an operational state of the electric motor for revolution 21 (power running or regenerative operation, and an operational state of the motor generator 300 (power running or regenerative operation), by which the charge and discharge control of the capacitor 19 is performed.

The switching control between the boost operation and the step-down operation of the buck-boost converter 100 is performed based on the DC bus voltage value detected by the DC bus voltage detection part 111, the capacitor voltage value defected by the capacitor voltage detection part 112, and the capacitor current value detected by the capacitor current detection part 113.

In the above configuration, the electrical power generated by the motor generator 12 that is an assist motor is supplied to the DC bus 110 of the electrical storage system 120 through the inverter 18A, and then supplied to the capacitor 19 through the buck-boost converter 100. Moreover, the regenerative electrical power that the electric motor for revolution 21 has generated by the regenerative operation is supplied to the DC bus 110 of the electrical storage system 120 through the inverter 20, and then supplied to the capacitor 19 through the buck-boost converter 100. Furthermore, the electrical power that the motor generator 300 for boom regeneration has generated is supplied to the DC bus 110 of the electrical storage system 120 through the inverter 18C, and then supplied to the capacitor 19 through the buck-boost converter 100. Here, the electrical power that the motor generator 12 or the motor generator 300 has generated may be directly supplied to the electric motor for revolution 21 through the inverter 20; the electrical power that the electric motor for revolution 21 or the motor generator 300 has generated may be directly supplied to the motor generator 12 through the inverter 18A; and the electrical power that the motor generator 12 or the electric motor for revolution 21 has generated may be directly supplied to the motor generator 300 through the inverter 18C.

The capacitor 19 may be a rechargeable and dischargeable electric condenser capable of transferring the electrical power from and to the DC bus 110 through the buck-boost converter 100. Here in FIG. 4, although the capacitor 19 is illustrated as an electric condenser, a rechargeable and dischargeable secondary battery such as lithium-ion battery and the like, a lithium-ion capacitor, or another form of power source capable of transferring the electric power may be used as the electric condenser instead of the capacitor 19.

In addition to the above functions, the controller 30 further performs the drive control of the fluid communication circuit 320 depending on the drive mode of the hybrid type shovel.

Figure 5:
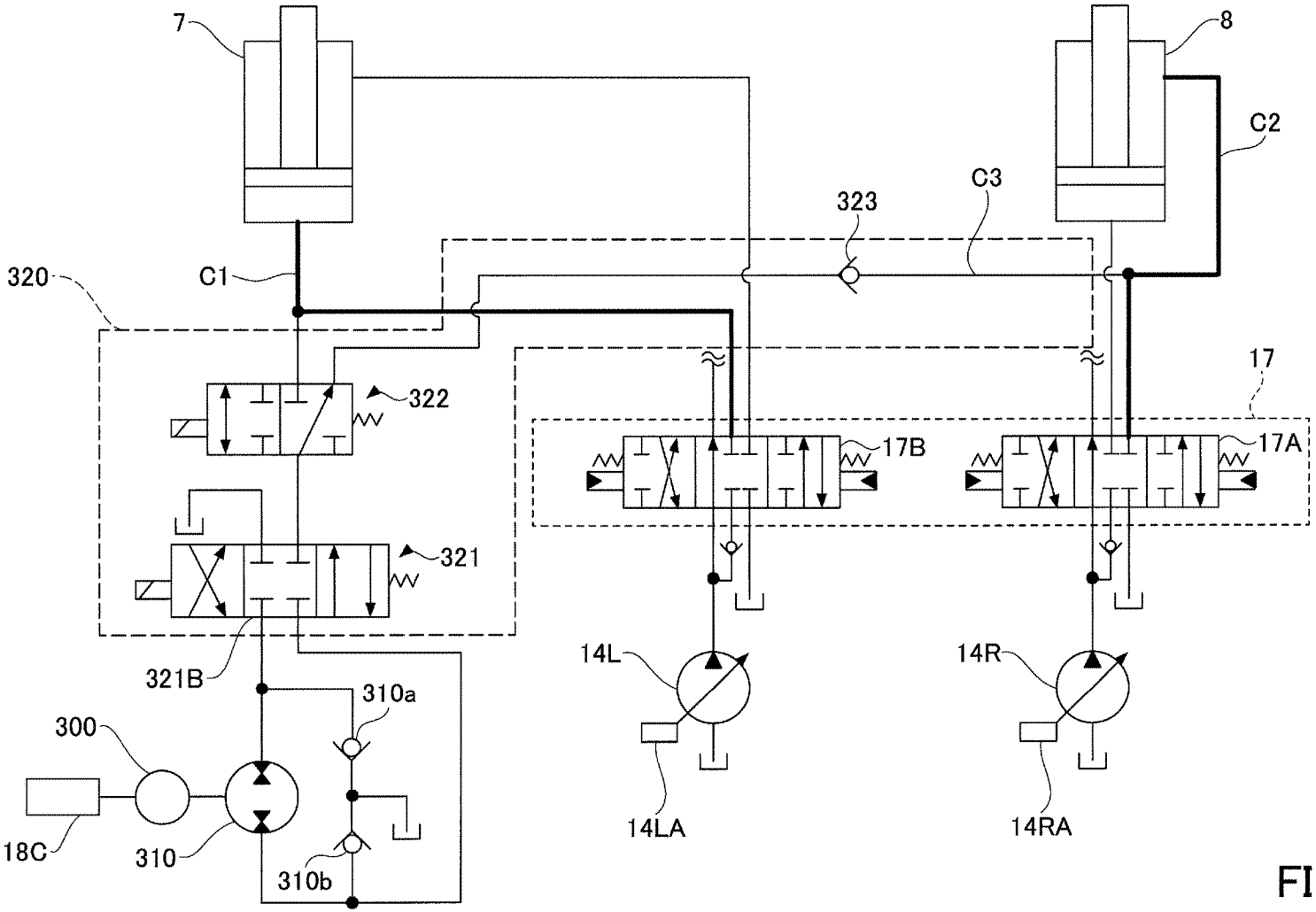
FIG. 5 is a drawing illustrating a fluid communication circuit of a hybrid type shovel in a first drive mode according to an embodiment of the present invention.

Here, a detailed description is given below of the fluid communication circuit 320 with reference to FIG. 5. Here, FIG. 5 is a drawing illustrating a configuration example of the fluid communication circuit 320. In the first embodiment, the fluid, communication circuit 320 is constituted of a first electromagnetic valve 321, a second electromagnetic valve 322, and a non-return valve 323. The fluid communication circuit 320 is arranged so as to connect a boom cylinder bottoms side oil passage C1 (which is expressed by a thick line for emphasis) connecting a bottom side oil chamber of the boom cylinder 7 with the control valve 17, and an arm cylinder rod side oil passage C2 (which is also expressed by a thick line for emphasis) connecting a rod side oil chamber of the arm cylinder 8 with the control valve 17, to the hydraulic pump-motor 310.

The first electromagnetic valve 321 is an electromagnetic valve that switches a supply source of the hydraulic oil flowing into the hydraulic pump-motor 310, and switches a supply destination of the hydraulic oil flowing out of the hydraulic pump-motor 310. The first electromagnetic valve 321 is, for example, a 4-port, 3-position spool valve. The supply source of the hydraulic oil that flows into the hydraulic pump-motor 310 is, for example, the bottom, side oil chamber of the boom cylinder 7 or a hydraulic oil tank. Moreover, the supply destination of the hydraulic oil flowing out of the hydraulic pump-motor 310 is, for example, the hydraulic oil tank, the bottoms side oil chamber of the boom cylinder 7, or the rod side oil chamber of the arm cylinder 8.

The second electromagnetic valve 322 is an electromagnetic valve to switch and choose between the connection between the boom cylinder bottom side oil passage C1 and the hydraulic pump-motor 310, and the connection between the arm cylinder rod side oil passage C2 and the hydraulic pump-motor 310. The second electromagnetic valve 322 is, for example, a 4-port, 2-position spool valve.

The non-return valve 323 is installed in an oil passage C3 connecting the arm cylinder rod side oil passage C2 to the second electromagnetic valve 322, and is a valve that prevents the hydraulic oil from flowing from the arm cylinder rod side oil passage C2 to the hydraulic pump-motor 310.

Furthermore, check valves 310*a* and 310*b* are arranged between each of two discharge ports of the hydraulic pump-motor 310 and the hydraulic oil tank. This aims to maintain the pressure of the discharge ports at a pressure of the hydraulic oil tank or higher by supplying hydraulic oil to the discharge ports from the hydraulic oil tank when a pressure in each of two of the discharge ports becomes lower than a pressure of the hydraulic oil tank.

Figure 6:
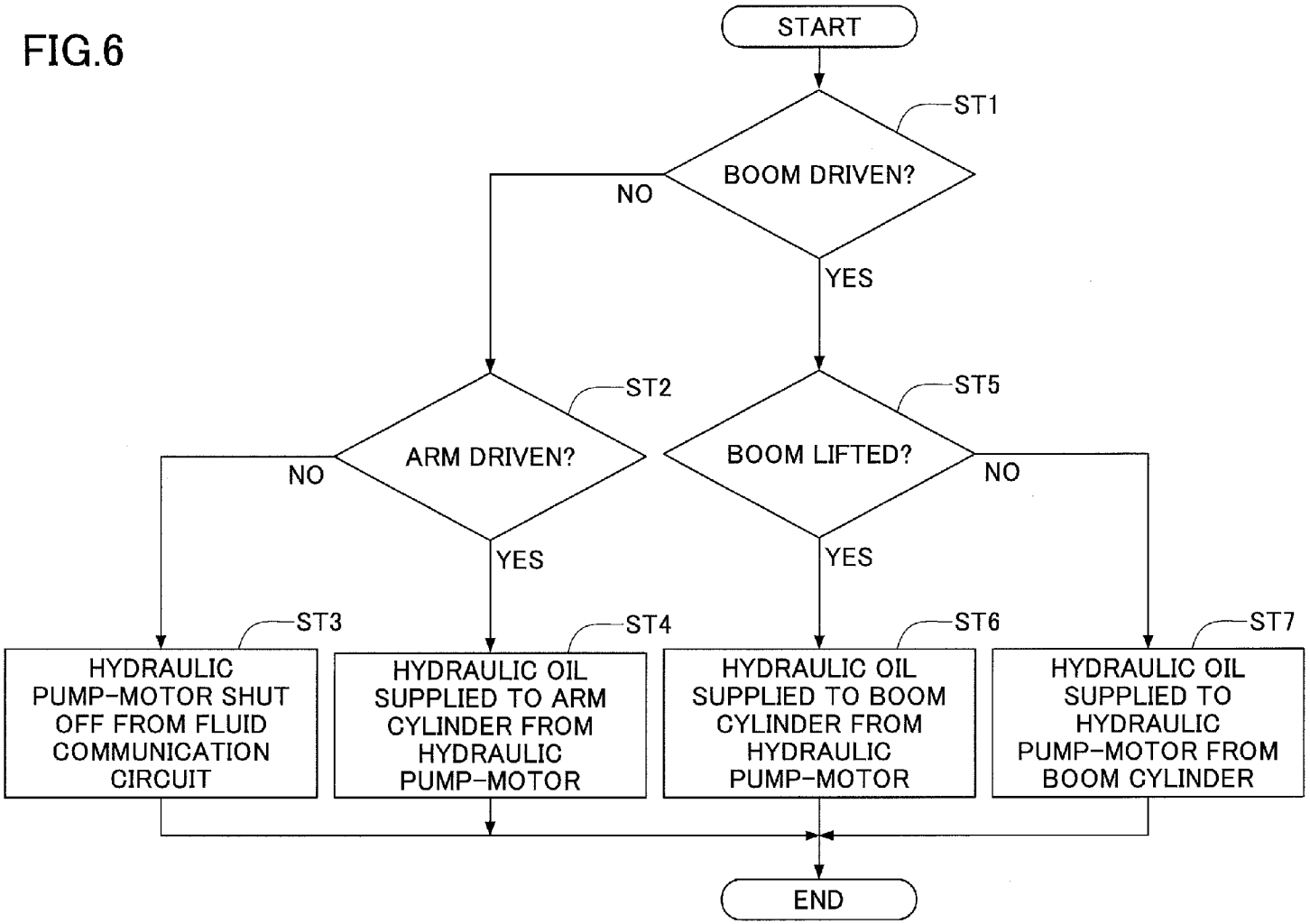
FIG. 6 is a flowchart illustrating a flow of a first fluid communication circuit driving process according to an embodiment of the present invention.

A description is given below of a process of controlling a flow of the hydraulic oil in the fluid communication circuit 320 by the controller 30 (which is hereinafter called a "first fluid communication circuit drive process"). Here, FIG. 6 is a flowchart illustrating the flow of the first fluid communication circuit drive process, and the controller 30 performs the first fluid communication circuit drive process while operating the shovel at a predetermined, control cycle repeatedly.

To begin with, the controller 30 detects a manipulated variable of the boom, control lever based, on an output of the pressure sensor 29, and determines whether the boom 4 is driven or not (step ST1). Moreover, the controller 30 may determine whether the boom 4 is driven or not based on an output of an angle sensor (which is not shown in the drawing) that detects a rotation angle of the boom 4, or a displacement sensor (which is not shown in the drawing) that detects a displacement (expansion and contraction) of the boom cylinder 7. This is similar to a case of determining whether the arm 5 or the bucket 6 is driven or not.

When determining that the boom 4 is not driven (NO of step ST1), the controller 30 detects a manipulated variable of the arm control lever based on the output of the pressure sensor 29, and determines whether the arm 5 is driven or not (step ST2).

When determining that the arm 5 is not driven (No of step ST2), the controller 3 shuts off the hydraulic pump-motor 310 form the fluid communication circuit 320 (step ST3).

Hereinafter, this state in which any of the boom 4 and the arm 5 are in a non-driven state is called a first drive mode. FIG. 5 illustrates a state of the fluid communication circuit 320 in which the hybrid type shovel is in the first drive mode.

More specifically, the controller 30 outputs a predetermined control signal to the first electromagnetic valve 321 in the fluid communication circuit 320, switches a position of the valve to a second, valve position 321B, and shuts off the hydraulic pump-motor 310 from the fluid communication circuit 320. In addition, the controller 30 outputs a predetermined control signal to the inverter 18C, and stops rotation of the motor generator 300 and the hydraulic pump-motor 310.

On the other hand, when determining that the arm 5 is driven (when the arm 5 is driven toward an opening direction in the first embodiment) (YES of step ST2), the controller 30 causes the hydraulic pump-motor 310 to function as a hydraulic pump, and causes to supply the hydraulic oil that the hydraulic pump-motor 310 discharges to the rod side oil chamber of the arm cylinder 8 (step ST4).

Figure 7:
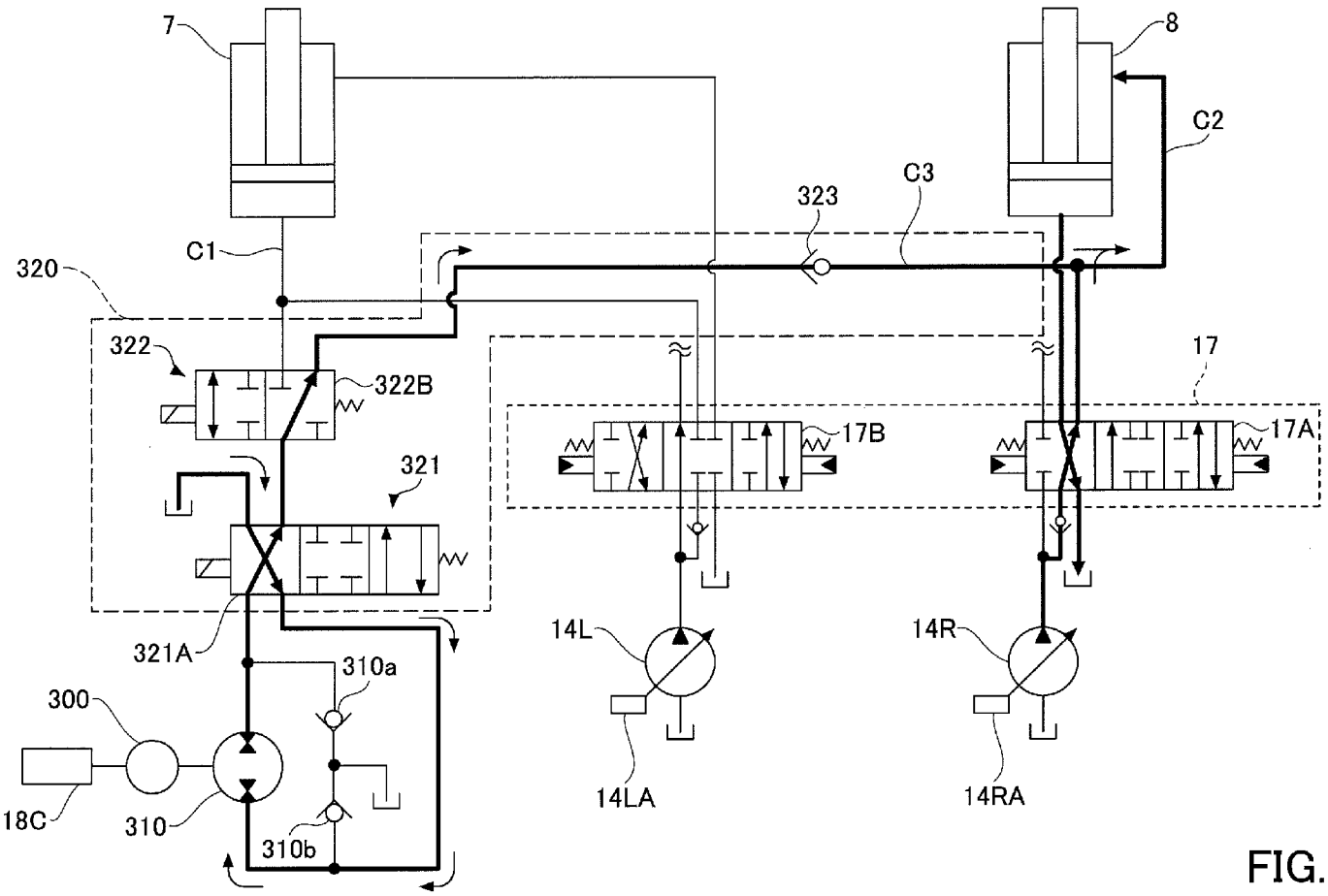
FIG. 7 is a drawing illustrating a state of a fluid communication circuit of a hybrid type shovel in a second drive mode according to an embodiment of the present invention.

Hereinafter, this state in which the arm 5 is in a drive status (a state of the arm 5 opening in the first embodiment) when the boom 4 is in a non-driven state, is called a second, drive mode. FIG. 7 described later illustrates a state of the fluid communication circuit 320 in which the hybrid type shovel is in the second drive mode. For example, the hybrid type shovel goes into the second drive mode during the dumping operation.

More specifically, the controller 30 outputs a predetermined control signal to the first electromagnetic valve 321 and the second electromagnetic valve 322 in the fluid communication circuit 320, and causes the arm cylinder rod side oil passage C2 to communicate with the hydraulic pump-motor 310. Moreover, the controller 30 outputs a predetermined control signal to the inverter 18C, and causes the motor generator 300 and the hydraulic pump-motor 310 to start their rotation.

Furthermore, the controller 30 controls a discharge rate of a main pump 14R by outputting a predetermined control signal to a regulator 14RA, and causes the hydraulic oil to be supplied to the rod side oil chamber of the arm cylinder 8 at an intended flow rate by using the hydraulic oil discharged from the hydraulic pump-motor 310 and the hydraulic oil discharged from the main pump 14R. Here, the controller 30 may drive the arm 5 toward an opening direction by supplying only the hydraulic oil discharged from the hydraulic pump-motor 310 to the rod side oil chamber of the arm cylinder 8.

By doing this, the controller 30 causes the hydraulic pump-motor 310 to function as a hydraulic pump, and can use the hydraulic oil that the hydraulic pump-motor 310 discharges in order to drive the arm 5 (to open the arm 5 in the first embodiment). As a result, the controller 30 can make use of the hydraulic pump-motor 310 more efficiently.

In addition, when determining that the boom 4 is driven (YES of step ST1), the controller 30 determines whether the boom 4 is driven in a lifting direction (step ST5).

When determining that the boom 4 is driven in the lifting direction (YES of step ST5), the controller 30 causes the hydraulic pump-motor 30 to function as a hydraulic pump, and causes the hydraulic oil discharged from the hydraulic pump-motor 310 to be supplied to the bottom side oil chamber of the boom cylinder 7 (step ST6).

Hereinafter, this state in which the boom 4 is lifted is called a third drive mode, FIG. 8 described later illustrates a state of the fluid communication circuit 320 when the hybrid type shovel is in the third drive mode. The hybrid type shovel, for example, goes into the third drive state during the boom lifting and swiveling operation.

More specifically, the controller 30 causes the boom cylinder bottom side oil passage C1 to communicate with the hydraulic pump-motor 310 by outputting a predetermined control signal to the first electromagnetic valve 321 and the second electromagnetic valve 322 in the fluid communication circuit 320. Moreover, the controller 30 causes the motor generator 300 and the hydraulic pump-motor 310 to start their rotation by outputting the predetermined control signal to the inverter 18C.

Furthermore, the controller 30 controls a discharge rate of the main pump 14L by outputting a predetermined control signal to a regulator 14LA, and causes the hydraulic oil to be supplied to the bottom side oil chamber of the boom cylinder 7 at an intended flow rate by using the hydraulic oil discharged from the hydraulic pump-motor 310 and the hydraulic oil discharged from the main pump 14L. Here, the controller 30 may drive the boom 4 in the lifting direction by supplying only the hydraulic oil that the hydraulic pump-motor 310 discharges to the bottom side oil chamber of the boom cylinder 7.

By doing this, the controller 30 causes the hydraulic pump-motor 310 to function as a hydraulic pump, and can use the hydraulic oil discharged from the hydraulic pump-motor 310 in order to drive the boom 4 in the lifting direction. As a result, the controller 30 can make use of the hydraulic pump-motor 310 more efficiently.

On the other hand, when determining that the boom 4 is driven to a downward direction (NO of step ST5), the controller 30 causes the hydraulic oil that flows out of the bottom side oil chamber of the boom cylinder 7 to be supplied to the hydraulic pump-motor 310, and causes the hydraulic pump-motor 310 to function as a hydraulic motor (step ST7).

Figure 9:
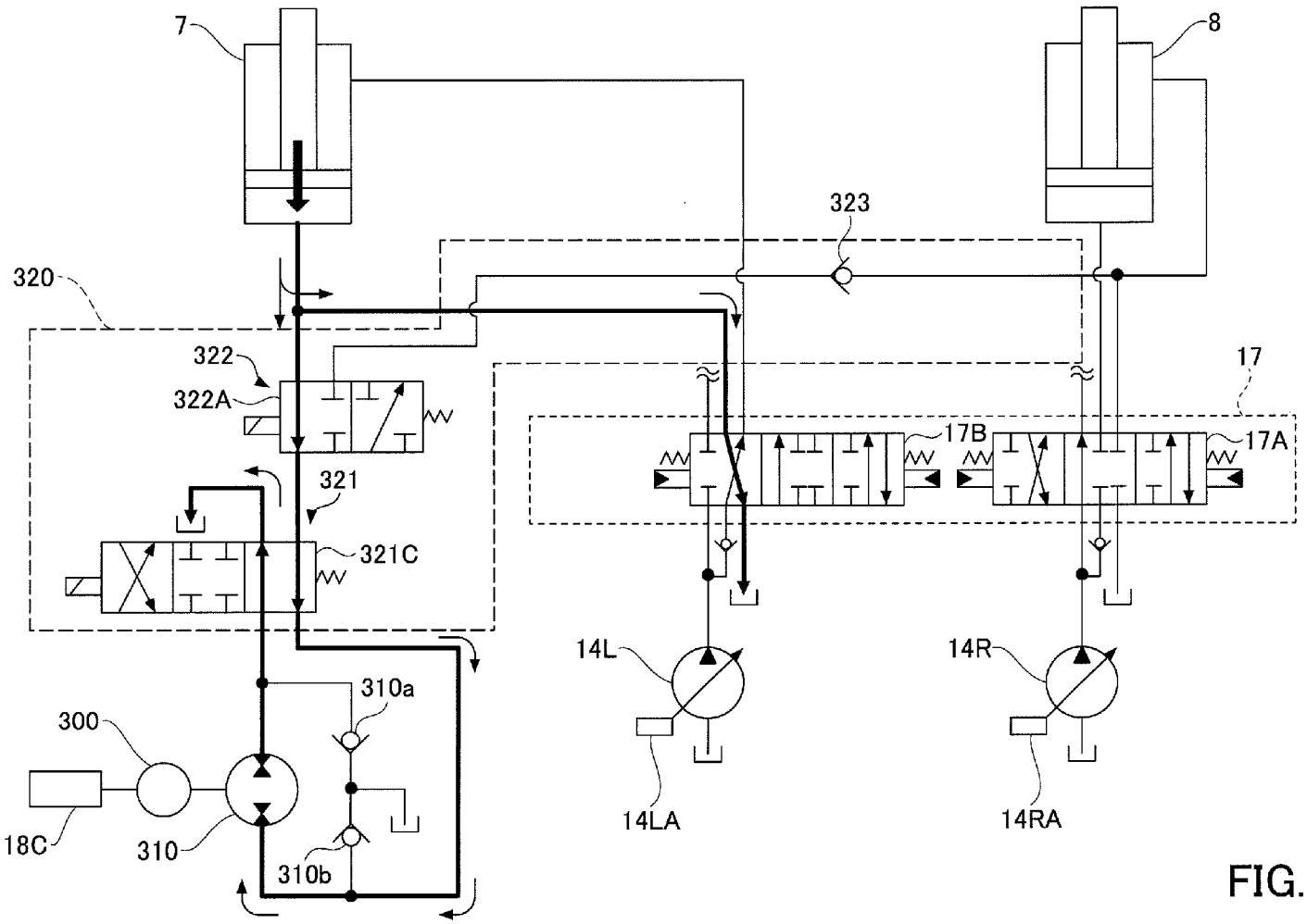
FIG. 9 is a drawing illustrating a state of a fluid communication circuit of a hybrid type shovel in a fourth drive mode according to an embodiment of the present invention.

Hereinafter, this state of the boom 4 moving down is called a fourth drive mode. FIG. 9 described later illustrates a state of the fluid communication circuit 320 when the hybrid type shovel is in the fourth drive mode. The hybrid type shovel, for example, goes into the fourth drive mode during the boom, lowering and swiveling operation.

More specifically, the controller 30 outputs a predetermined control signal to the first electromagnetic valve 321 and the second, electromagnetic valve 322 in the fluid communication circuit 320, and causes the boom cylinder bottom side oil passage C1 to communicate with the hydraulic pump-motor 310. Moreover, the controller 30 outputs a predetermined control signal to the inverter 18C, and causes the motor generator 300 to rotate for regeneration.

By doing this, the controller 30 can cause the hydraulic pump-motor 310 to function as the hydraulic motor, and can utilize the hydraulic pump-motor 310 in order to regenerate the positional energy of the boom 4.

Furthermore, in the first embodiment, although the controller 30 use the hydraulic oil discharged from the hydraulic pump-motor 310 for the drive of the boom 4 or the arm 5, the controller 30 may use the hydraulic oil for the drive of the bucket 6 or for the running of the base carrier 1.

A detailed description is given below of respective states of the fluid communication circuit 320 of the second drive mode, the third drive mode, and the fourth drive mode with reference to FIGS. 7 through 9. Thick bold lines in FIGS. 7 through 9 indicate that flows of the hydraulic oil have occurred.

Firstly, a description is given below of a state of the fluid communication circuit 320 in the second drive mode, with reference to FIG. 7.

FIG. 7 illustrates a state of the hydraulic oil discharged from the main pump 14R flowing into the rod side oil chamber of the arm cylinder 8, Here, the arm cylinder rod side oil passage C2 is also called a "first oil passage" as an oil passage that supplies the hydraulic oil discharged from the main pump 14R to a hydraulic actuator of the drive object, that is to say, as the first oil passage that supplies the hydraulic oil to the hydraulic actuator of the drive object.

In such a state, the controller 30 outputs a control signal to the first electromagnetic valve 321, and switches over the valve position thereof to a first valve position 321A. In addition, the controller 30 outputs a control signal to the second electromagnetic valve 322, and switches over the valve position thereof to a second valve position 322B. As a result, the hydraulic oil that the hydraulic pump-motor 310 discharges reaches the arm cylinder rod side oil passage C2 (first oil passage) through the first electromagnetic valve 321, the second electromagnetic valve 322 and the oil passage C3, merges into the hydraulic oil discharged from the main pump 14R, and flows into the rod side oil chamber of the arm cylinder 8. Here, the oil passage connecting the arm cylinder rod side oil passage C2 to the oil pump-motor 310 (including the oil passage C3) is also called a "second oil passage" as an oil passage that supplies the hydraulic oil discharged from the hydraulic pump-motor 310 to the hydraulic actuator of the drive object, that is to say, as the second oil passage that supplies the hydraulic oil to the hydraulic actuator of the drive object.

In addition, the controller 30 adjusts a discharge rate of the main pump 14R by outputting a control signal to the regulator 14RA, and for example, causes the flow rate of the hydraulic oil flowing from the main pump 14R to the rod side oil chamber of the arm cylinder 8 to decrease by a flow rate of the hydraulic oil that the hydraulic pump-motor 310 discharges. This aims to reduce the discharge rate of the main pump 14R without slowing down the movement of the arm 5, and to reduce pressure loss at the control valve 17. Moreover, the controller 30 may reduce or zero the flow rate of the hydraulic oil flowing from the main pump 14R to the rod side oil chamber of the arm cylinder 8 by controlling a flow rate control valve for arm 17A that is one of the control valves 17 (i.e., 17A and 17B). This aims to supply the hydraulic oil that the main pump 14R discharges to another hydraulic actuator without slowing down the movement of the arm 5. Here, when the flow rate of the hydraulic oil flowing from the main pump 14R to the rod side oil chamber of the am cylinder 8 is zeroed, only the hydraulic oil that the hydraulic pump-motor 310 discharges is supplied to the rod side oil chamber of the arm cylinder 8. Moreover, the controller 30 may cause the hydraulic oil that the hydraulic pump-motor 310 discharges to be supplied to the rod side oil chamber of the arm cylinder 8 without reducing the flow rate of the hydraulic oil flowing from the main pump 14R to the rod side oil chamber of the arm cylinder 8. This aims to compensate for lack of the discharge rare from the main pump 14R, or to increase the moving speed of the arm 5.

In this manner, the fluid communication circuit 320 causes the hydraulic oil discharged from the hydraulic pump-motor 310 to flow into the rod side oil chamber of the arm cylinder 8 in the second drive mode in which the arm 5 is opened when the boom 4 is in a non-drive state.

Here, the oil passage C3 may meet the oil passage connecting the bottom side oil chamber of the arm cylinder 8 to the control valve 17. In this case, the hydraulic oil that the hydraulic pump-motor 31 discharges flows into the bottom side oil chamber of the arm cylinder 8 and is used for closing the arm 5 in the second drive mode.

Next, a description is given below of a state of the fluid communication circuit 320 in the third drive mode with reference to FIG. 8.

Figure 8:
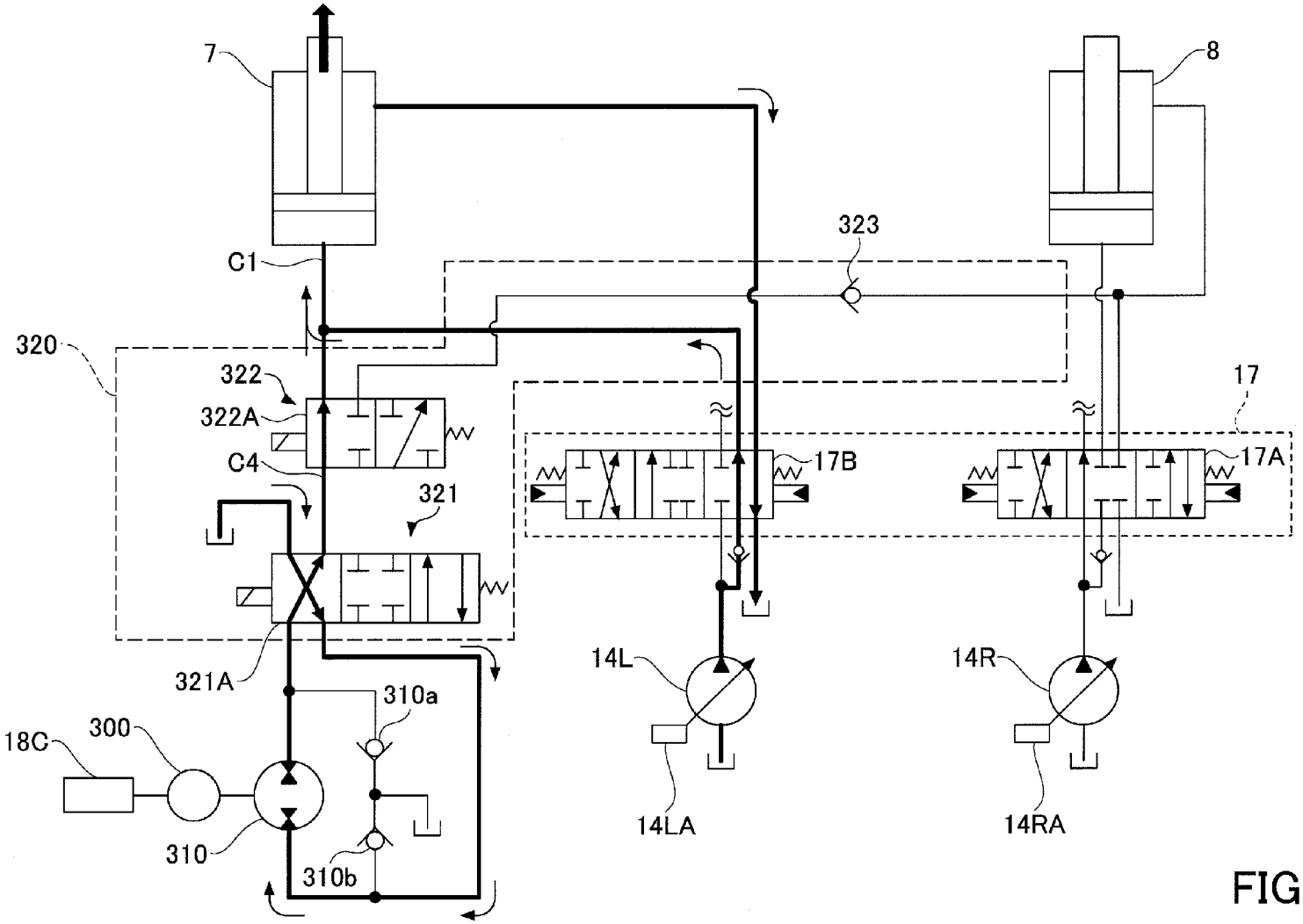
FIG. 8 is a drawing illustrating a state of a fluid communication circuit of a hybrid type shovel in a third drive mode according to an embodiment of the present invention.

FIG. 8 illustrates a state in which the hydraulic oil that the main pump 14L discharges flows into the bottom side oil chamber of the boom cylinder 7. Here in this case, the first oil passage becomes the boom cylinder bottom side oil passage C1. The boom cylinder bottom side oil passage C1 is an oil passage that supplies the hydraulic oil discharged from the main pump 14L to a hydraulic actuator of the drive object, that is to say, the first oil passage that supplies the hydraulic oil to the hydraulic actuator of the drive object.

In such a state, the controller 30 outputs the control signal to the first electromagnetic valve 321, and switches over the valve position thereof to the first valve position 321A. In addition, the controller 30 outputs a control signal to the second electromagnetic valve 322, and switches over the valve position thereof to a first valve position 322A. As a result, the hydraulic oil discharged from the pump motor 310 reaches the boom cylinder bottom side oil passage C1 (first oil passage) through the first electromagnetic valve 321 and the second electromagnetic valve 322, merges into the hydraulic oil discharged from the main pump 14L, and flows into the bottom side oil chamber of the boom cylinder 7. Here, the second oil passage in this case becomes an oil passage C4 that connects the hydraulic pump-motor 310 to the boom cylinder bottom side oil passage C1. The oil passage C4 is an oil passage that supplies the hydraulic oil discharged from the hydraulic pump-motor 310 to a hydraulic actuator of the drive object, that is to say, a second oil passage that supplies the hydraulic oil to the hydraulic actuator of the drive object.

Moreover, the controller 30 adjusts the discharge rate of the main pump 14L by output ting a control signal to the regulator 14LA, and for example, reduce a flow rate of the hydraulic oil flowing from the main pump 14L to the bottom side oil chamber of the boom cylinder 7 by a flow rate that the hydraulic pump motor 310 discharges. This aims to reduce the discharge rate from the main pump 14L without slowing down the movement of the boom 4 in the lifting direction, and to reduce the pressure loss at the control valve 17. Furthermore, the controller 30 may reduce or zero the flow rate of the hydraulic oil flowing from the main pump 14L to the bottom side oil chamber of the boom cylinder 7 by controlling a flow rate control valve for boom 17B that is one of the control valves 17 (i.e., 17A and 17B). This aims to be able to supply the hydraulic oil discharged from the main pump 14L to another hydraulic actuator without slowing down the movement of the boom 4 in the lifting direction. Here, when the flow rate of the hydraulic oil flowing from the main pump 14L to the bottom side oil chamber of the boom cylinder 7 is zeroed, only the hydraulic oil that the hydraulic pump-motor 310 discharges is supplied to the bottom side oil chamber of the boom cylinder 7. In addition, the controller 30 may supply the hydraulic oil discharged from the hydraulic pump-motor 310 to the bottom side oil chamber of the boom cylinder 7 without reducing the flow rate of the hydraulic oil flowing from the main pump 14L to the bottom side oil chamber of the boom cylinder 7. This aims to compensate for lack of the discharge rate of the main pump 14L, or to increase the moving speed of the boom 4.

In this way, the fluid communication circuit 320 causes the hydraulic oil that the hydraulic pump-motor 310 discharges to flow into the bottom side oil chamber of the boom cylinder 7 in the third drive mode in which the boom 4 is lifted.

A description is given below of a state of the fluid communication circuit 320 in the fourth drive mode with reference to FIG. 9.

The controller 30 outputs a control signal to the first electromagnetic valve 321, and switches the valve position thereof to a third valve position 321C. Moreover, the controller 30 outputs the control signal to the second electromagnetic valve 322, and switches the valve position thereof to the first valve position 322A. Furthermore, the controller 30 causes the motor generator 300 and the hydraulic pump motor 310 to stop rotating, and to go into a state capable of the regenerative operation by outputting a control signal to the inverter 18C. As a result, a part or all of the hydraulic oil flowing out of the bottom side of the boom cylinder 7 flows into the hydraulic pump-motor 310 through the second electromagnetic valve 322 and the first electromagnetic valve 321, and the other part is discharged to the hydraulic oil tank through the flow rate control valve 17B of the control valve 17.

Thus, the fluid communication circuit 320 causes the hydraulic oil flowing out of the bottom side oil chamber of the boom cylinder 7 to flow into the hydraulic pump-motor 310 in the fourth drive mode in which the boom 4 is lowered.

With this structure, the hybrid type shovel according to the first embodiment of the present invention causes the hydraulic pump-motor 310 to function as the hydraulic pump in the second drive mode and the third drive mode, and the hydraulic pump-motor 310 to function as the hydraulic motor for regeneration in the fourth drive mode. As a result, the hybrid type shovel can make good use of the hydraulic pump-motor 310.

In addition, the hybrid type shovel according to the first embodiment of the present invention causes the hydraulic oil that the hydraulic pump-motor 310 discharges to merge into the hydraulic oil discharged from the main pump 14R or 14L between the hydraulic actuator of the drive object and the control valve 17. As a result, the hybrid type shovel can efficiently supply the hydraulic oil discharged from the hydraulic pump-motor 310 to the hydraulic actuator of the drive object while preventing the pressure loss that occurs at the control valve 17.

Second Embodiment

Next, a description is given below of a second embodiment of the present invention. Here, configurations of a drive system and an electrical storage system in the hybrid type shovel according to the second embodiment are similar to the drive system and the electrical storage system in the hybrid type shovel according to the first embodiment illustrated in FIGS. 3 and 4.

In the second embodiment, a boom cylinder pressure sensor 31 to detect a pressure of the hydraulic oil in the bottom side oil chamber of the boom cylinder 7 is attached to the boom cylinder 7, and an arm cylinder pressure sensor S2 to detect a pressure of the hydraulic oil in the rod side oil chamber of the arm cylinder 8 is attached to the arm cylinder 8. Each of the boom cylinder pressure sensor S1 and the arm cylinder pressure sensor 32 is an example of a hydraulic actuator pressure detection part, and outputs a detected pressure value to the controller 30.

Moreover, in the second embodiment, the fluid communication circuit 320 is a hydraulic circuit to operate the function of the hydraulic pump-motor 310 by switching between the hydraulic pump and the hydraulic motor. The fluid communication circuit 320, for example, supplies all or a part of the hydraulic oil flowing out of the boom, cylinder 7 in response to a control signal from the controller 30 to the hydraulic pump-motor 310, and causes the hydraulic pump-motor 310 to operate as a hydraulic motor for boom regeneration. Furthermore, the fluid communication circuit 320 supplies all or a part of the hydraulic oil flowing out of the boom cylinder 7 to the hydraulic pump-motor 310 that operates as a hydraulic pump, and supplies the hydraulic oil that the hydraulic pump-motor 310 discharges to the arm cylinder 8. A description is given later of operation of the fluid communication circuit 320.

Figure 10:
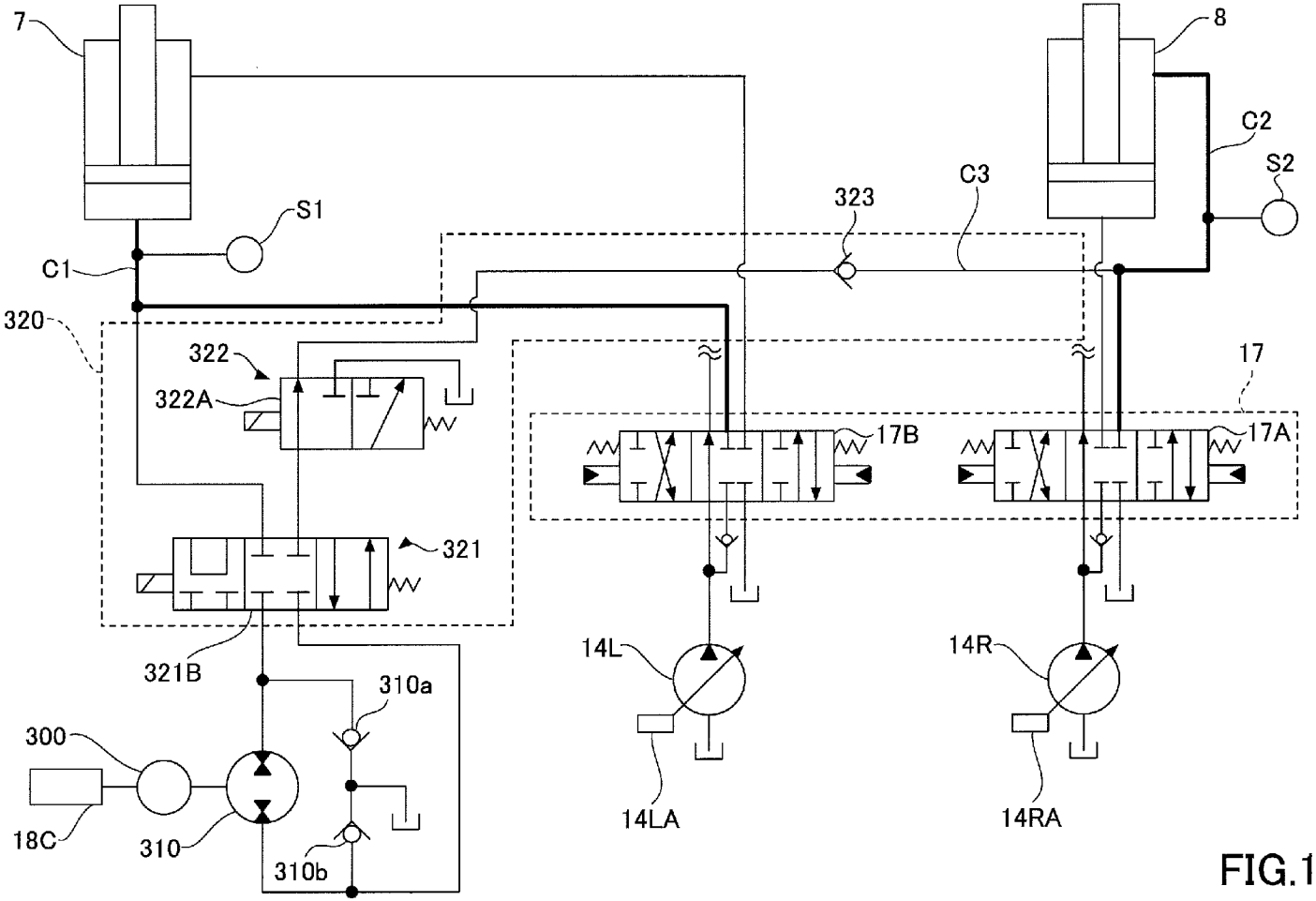
FIG. 10 is a drawing illustrating a state of a fluid communication circuit of a hybrid type shovel in a fifth drive mode according to an embodiment of the present invention.

A detailed description is given below of the fluid communication circuit 320 in the second embodiment with reference to FIG. 10. Here, FIG. 10 is a drawing illustrating a configuration example of the fluid communication circuit 320, and the fluid communication circuit 320 is constituted of a first electromagnetic valve 321, a second electromagnetic valve 322, and a non-return valve 323. The fluid communication circuit 320 is arranged to connect a boom cylinder bottom side oil passage C1 (which is expressed by a thick line for emphasis) connecting the bottom side oil chamber of the boom cylinder 7 with the control valve 17 and an arm cylinder rod side oil passage C2 (which is also expressed by a thick line for emphasis) connecting the rod side oil chamber of the arm cylinder 3 with the control valve 17, to the hydraulic pump-motor 310.

The first electromagnetic valve 321 is an electromagnetic valve that switches a supply source of the hydraulic oil flowing into the hydraulic pump-motor 310, and switches a supply destination of the hydraulic oil flowing out of the hydraulic pump-motor 310. For example, the first electromagnetic valve 321 is a 4-port, 3-position spool valve. The supply source of the hydraulic oil that flows into the hydraulic pump-motor 310 is, for example, the bottom side oil chamber of the boom cylinder 7 or the hydraulic oil tank. Also, the supply destination of the hydraulic oil flowing out of the hydraulic pump-motor 310 is, for example, the hydraulic oil tank or the rod side oil chamber of the aria cylinder 8.

The second electromagnetic valve 322 is an electromagnetic valve to switch and choose between a connection between the hydraulic oil tank and the hydraulic pump-motor 310, and a connection between the arm cylinder rod side oil passage C2 and the hydraulic pump-motor 310, The second electromagnetic valve 322 is, for example, a 3-port, 2-position spool valve.

The non-return valve 323 is installed in an oil passage C3 that connects the second electromagnetic valve 322 with the arm cylinder rod side oil passage C2, and is a valve that prevents the hydraulic oil from flowing from the arm cylinder rod side oil passage C2 to the hydraulic pump-motor 310.

Here, check valves 310*a* and 310*b* are arranged between each of two suction/discharge ports and the hydraulic oil tank. This is because when a pressure in each of two of the suction/discharge ports becomes a pressure lower than that of the hydraulic tank, the pressures of the suction/discharge ports are maintained at the pressure of the hydraulic oil tank or higher by supplying the hydraulic oil from the hydraulic oil tank.

Figure 11:
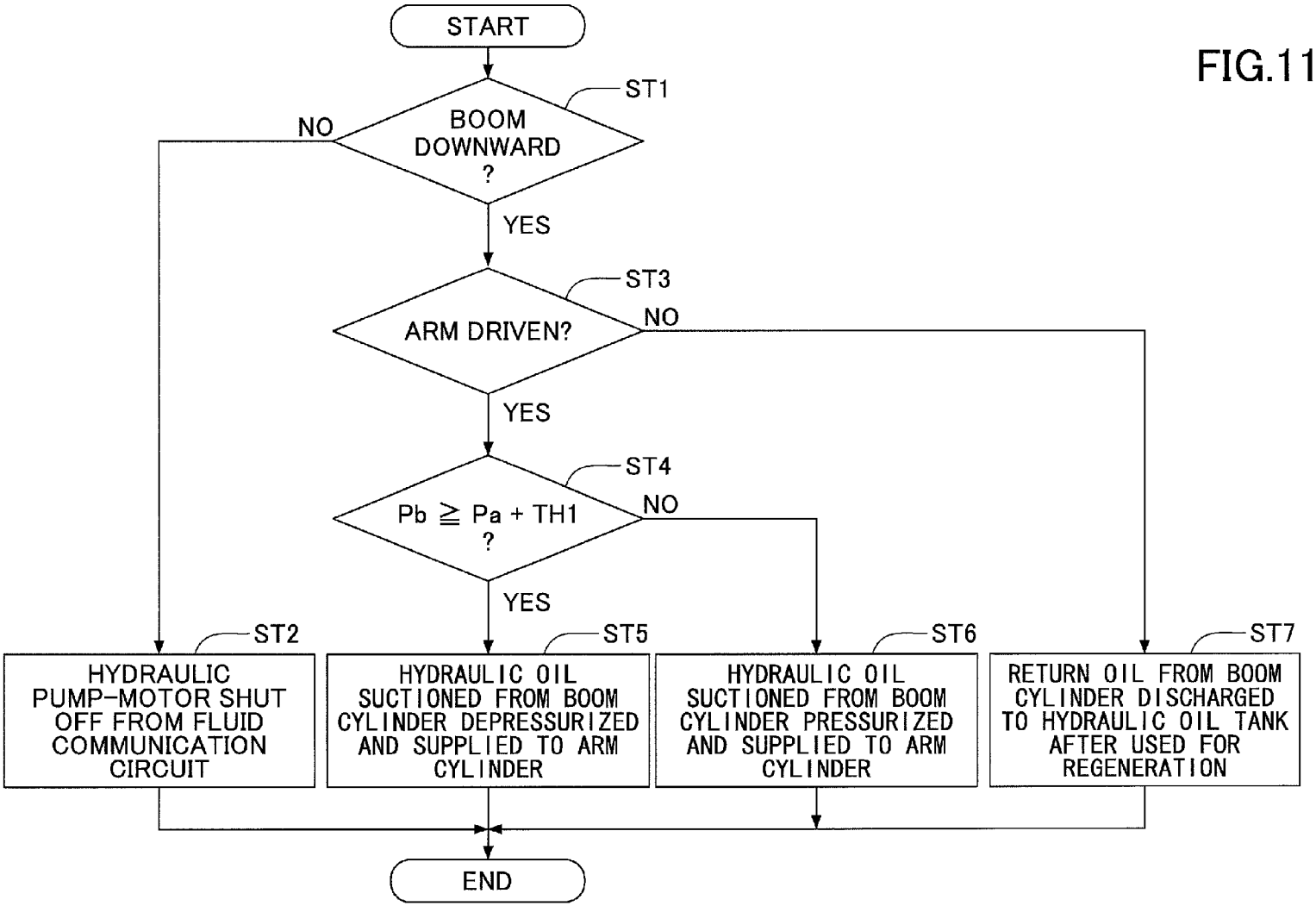
FIG. 11 is a flowchart illustrating a flow of a second fluid communication circuit driving process according to an embodiment of the present invention.

Here, referring to FIG. 11, a description is given below of a process by the controller 30 for controlling a flow of the hydraulic oil in the fluid communication circuit 320 in the second embodiment (which is hereinafter called a "second fluid communication circuit drive process"). FIG. 11 is a flowchart illustrating a flow of the second fluid communication circuit drive process, and the controller 30 executes the second fluid communication circuit drive process at a predetermined control cycle repeatedly during the shovel operation.

To begin with, the controller 30 detects a manipulated variable based on an output of the pressure sensor 29, and determines whether the boom 4 is driven in a downward direction (step ST1). Moreover, the controller 30 may determine whether the boom 4 is driven in the downward direction based on an angle sensor (not shown in the drawing) that detects a rotation angle of the boom 4, or a displacement sensor (not shown in the drawing) that detects a displacement (expansion and contraction) of the boom cylinder 7. This is similar to a case of determining whether the arm 5 or the bucket 6 is driven or not.

When determining that the boom 4 is not driven in the downward direction (NO of step ST1), the controller 30 shuts off the hydraulic pump-motor 310 from the fluid communication circuit 320 (step ST2).

Hereinafter, a state of not driving the boom 4 in the downward direction (which means that the boom 4 is driven in a lifting direction or not driven) is called a fifth drive mode. FIG. 10 illustrates an example of a state of the fluid communication circuit 320 when the hybrid type shovel is in the fifth drive mode.

More specifically, the controller 30 outputs a predetermined control signal to the first electromagnetic valve 321 in the fluid communication circuit 320, switches the valve position thereof to a second valve position 321B, and shuts off the hydraulic pump-motor 310 from the fluid communication circuit 320. In addition, the controller 30 outputs a predetermined control signal to the inverter 18C, and causes the motor generator 300 and the hydraulic pump-motor 310 to stop rotation thereof.

In contrast, when determining that the boom 4 is driven in the downward direction (YES of step ST1), the controller 30 detects a manipulated variable of the arm control lever based on the output of the pressure sensor 29, and determines whether the arm 5 is driven or not (step ST3).

When determining that the arm 5 is driven (YES of step ST3), the controller 30 further compares a pressure Pb of the hydraulic oil in the bottom side oil chamber of the boom cylinder 7 to a pressure (Pa+TH1) obtained by adding a predetermined pressure amount TH1 to a pressure Pa of the hydraulic oil in the rod side oil chamber of the arm cylinder 3 (step ST4).

When the pressure Pb is equal to or higher than the pressure (Pa+TH1) (YES of step St4), the controller 30 causes the hydraulic pump-motor 310 to function as a hydraulic pump. The hydraulic pump-motor 310 reduces the pressure Pb of the hydraulic oil that is suctioned from the bottom side oil chamber of the boom cylinder 7 up to the pressure (Pa+TH1), and discharges the depressurized hydraulic oil to the rod side oil chamber of the arm cylinder 8 (step ST5).

Hereinafter, a state in which the arm 5 is driven when the boom 4 is driven in the downward direction, and the pressure Pb becomes the pressure (Pa+TH1) or higher, is called a sixth drive state. The hybrid type shovel, for example, can go into the sixth state during the excavation operation or the dumping operation.

Figure 12:
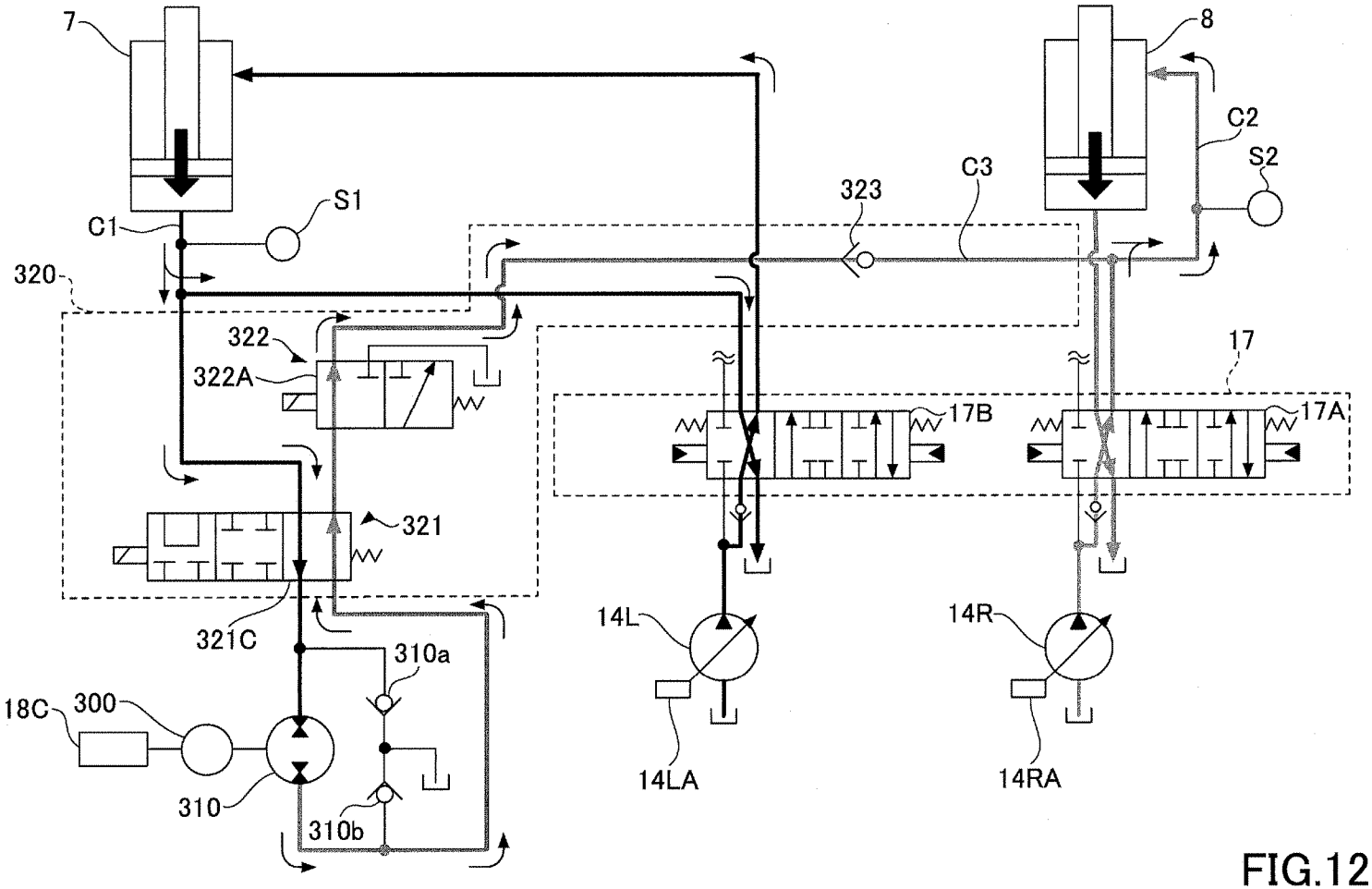
FIG. 12 is a drawing illustrating a state of a fluid communication circuit of a hybrid type shovel in a sixth drive mode according to an embodiment of the present invention.

More specifically, in FIG. 12, the controller 30 outputs a predetermined control signal to the first electromagnetic valve 321 and the second electromagnetic valve 322 in the fluid communication circuit 320, causes the boom cylinder bottom side oil passage C1 to communicate with the hydraulic pump-motor 310, and the arm cylinder rod side oil passage C2 to communicate with the hydraulic pump-motor 310 through the oil passage C3. Moreover, the controller 30 outputs a predetermined control signal to the inverter 18C, causes the hydraulic pump-motor 310 to function as a hydraulic pump, and drives the motor generator 300 for regeneration.

Furthermore, the controller 30 controls a discharge rate of the main pump 14R by outputting a predetermined control signal to the regulator 14RA, and causes the hydraulic oil to be supplied to the rod side oil chamber of the arm cylinder 8 at an intended flow rate by using the hydraulic oil discharged from the hydraulic pump-motor 310 and the hydraulic oil discharged from the main pump 14R. Here, the controller 30 may drive the arm 5 by supplying only the hydraulic oil that the hydraulic pump-motor 310 discharges to the rod side oil chamber of the arm cylinder 8.

By doing this, the controller 30 causes the hydraulic pump-motor 310 to function as a hydraulic motor, and causes the pressure of the hydraulic oil discharged from the hydraulic pump-motor 310 to be reduced to a proper level (i.e., a level to be able to supply to the arm, cylinder 8). Furthermore, the controller 30 causes the hydraulic oil discharged from the hydraulic pump-motor 310 to be efficiently used to drive the arm 5. This is because when the pressure of the hydraulic oil that the hydraulic pump-motor 310 discharges is much higher than the pressure of the hydraulic oil in the rod side oil chamber of the arm cylinder 8 (e.g., the pressure is Pa+TH1 or higher), the wasteful pressure loss is caused in supplying the hydraulic oil to the rod side oil chamber of the arm cylinder 8. By doing this, the controller 30 causes the hydraulic pump-motor 310 to be efficiently utilized.

In addition, when the pressure Pb is lower than the pressure (Pa+TH1) (NO of step ST4), the controller 30 causes the hydraulic pump-motor 310 to function as the hydraulic pump. The hydraulic pump-motor 310 increases the pressure Pb of the hydraulic oil suctioned from the bottom side oil chamber of the boom cylinder 7 up to the pressure (Pa+TH1), and discharges the pressurized hydraulic oil to the rod side oil chamber of the arm cylinder 8 (step ST3).

Hereinafter, a state of driving the arm 5 when the arm 4 is driven in the downward direction and of the pressure Pb lower than the pressure (Pa+TH1) is called a seventh drive mode. The hybrid type shovel, for example, can go into the seventh drive mode during the excavation operation or the dumping operation.

Figure 13:
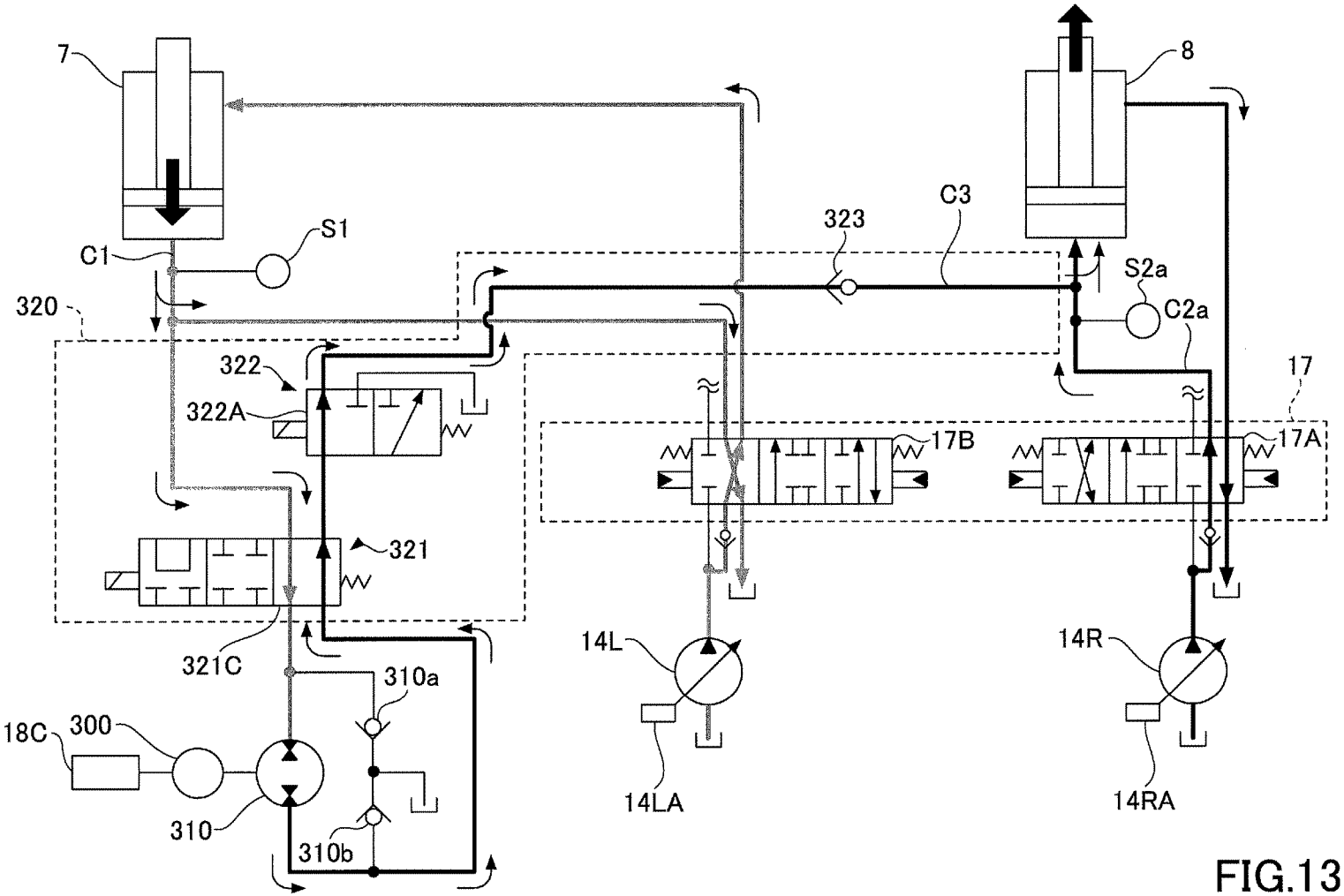
FIG. 13 is a drawing illustrating a state of a fluid communication circuit of a hybrid type shovel in a seventh drive mode according to an embodiment of the present invention.

More specifically, in FIG. 13, the controller 30 outputs a predetermined control signal to the first electromagnetic valve 321 and the second electromagnetic valve 322 in the fluid communication circuit 320, and communicates the boom cylinder bottom side oil passage C1 with the hydraulic pump-motor 310, and the arm cylinder bottom side oil passage C2*a* with the hydraulic pump-motor 310 through the oil passage C3. In addition, the controller 30 outputs a predetermined control signal to the inverter 18C, and causes the motor generator 300 to perform power running, and the hydraulic pump-motor 310 to function as the hydraulic pump.

On the other hand, when determining that the boom 4 is driven in the downward direction (YES of step ST1) and the arm 5 is not driven (NO of step ST3), the controller 30 causes the hydraulic pump-motor 310 to function as the hydraulic motor, and causes the hydraulic oil discharged from the hydraulic pump-motor 310 to be discharged to the hydraulic oil tank (step St7).

Hereinafter, a state of not driving the arm 5 when driving the boom 4 in the downward direction is called an eighth drive mode. The hybrid type shovel, for example, can go into the eighth drive mode during the boom lowering and swiveling operation.

Figure 14:
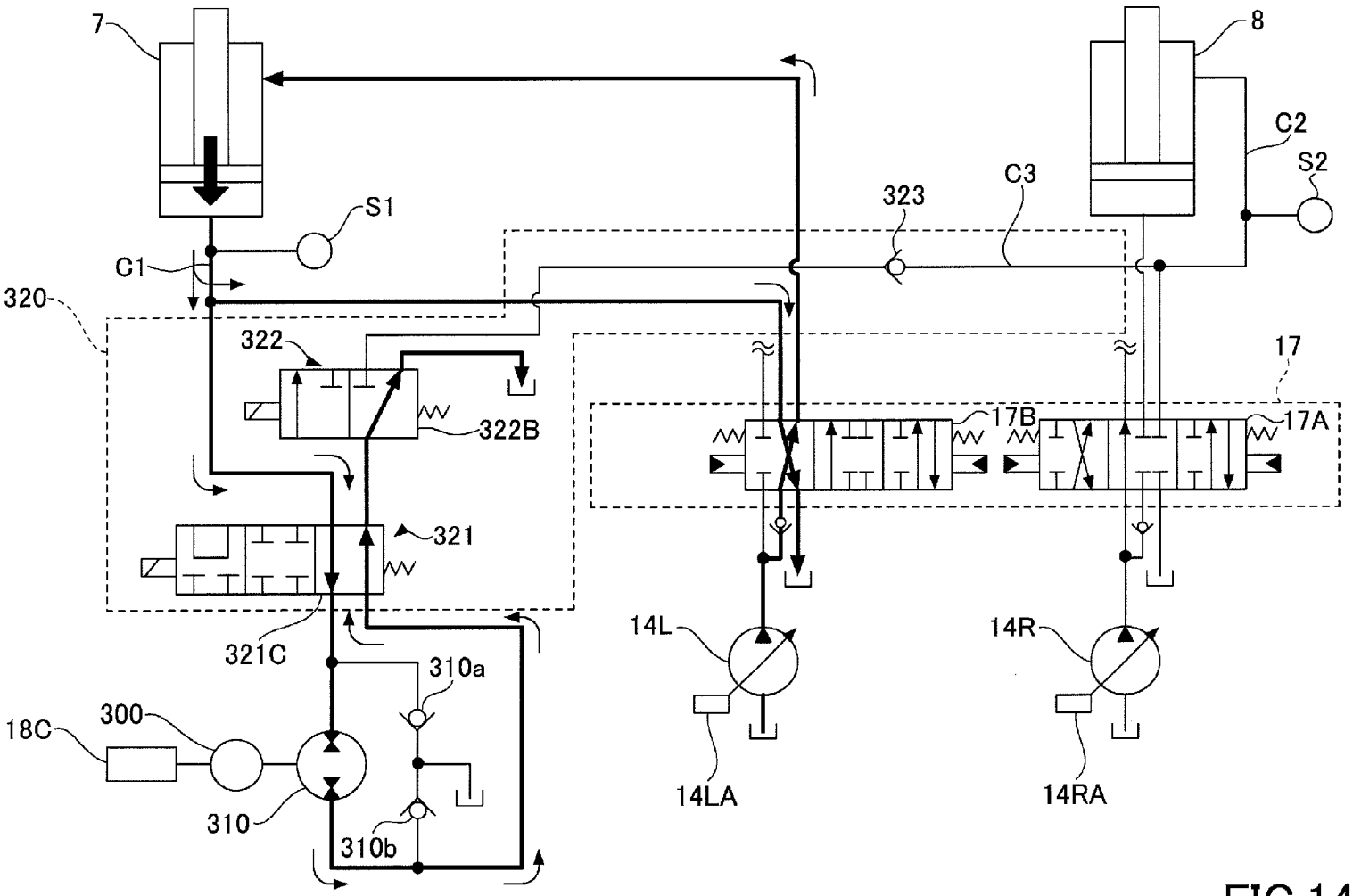
FIG. 14 is a drawing illustrating a state of a fluid communication circuit of a hybrid type shovel in an eighth drive mode according to an embodiment of the present invention.

More specifically, in FIG. 14, the controller 30 outputs a predetermined control signal to the first electromagnetic valve 321 and the second electromagnetic valve 322 in the fluid communication circuit 320, can cause the boom cylinder bottom side oil passage C1 to communicate with the hydraulic pump-motor 310 and cause the hydraulic oil tank to communicate with the hydraulic pump-motor 310. In addition, the controller 30 shuts off the communication between the arm cylinder rod side oil passage C2 and the hydraulic pump-motor 310. Moreover, the controller 30 outputs a predetermined control signal to the inverter 18C, and causes the hydraulic pump-motor 310 to function as the hydraulic motor, and the motor generator 300 to operate for regeneration.

In the second embodiment, the controller 30 supplies the hydraulic oil flowing out of the bottom side oil chamber of the boom cylinder 7 to the hydraulic pump-motor 310 when the boom 4 lowers by its own weight, and causes the hydraulic pump-motor 310 to function as the hydraulic motor, and the generator motor 300 to perform regenerative operation. However, the controller 30 may supply the hydraulic oil flowing out of the rod side oil chamber or the bottom side oil chamber to the hydraulic pump-motor 310 when the arm 5 opens and closes by its own weight, and may cause the hydraulic pump-motor 310 to function as the hydraulic motor and the motor generator 300 to perform the regenerative operation.

Furthermore, in the second embodiment, the controller 30 supplies the hydraulic oil that the hydraulic pump-motor 310 discharges to the arm cylinder 8, but may supply the hydraulic oil to the boom cylinder 7, the bucket cylinder 9, or the hydraulic motors for running 1A and 1B.

A detailed description is given below of a state of the fluid communication circuit 320 in each of the sixth drive mode, the seventh drive mode, and the eighth drive mode, with reference to FIGS. 12 through 14. Here, thick solid lines in FIGS. 12 through 14 mean that flows of the hydraulic oil are generated. Also, oil passages shown by gray and thick solid lines in each of FIGS. 12 and 13 mean that the pressure is lower than that in the passage shown by black and thick solid lines in the same drawing.

To begin with, a description is given below of a state of the fluid communication circuit 320 in the sixth drive mode with reference to FIG. 12.

FIG. 12 illustrates a state of the hydraulic oil discharged from the main pump 14L flowing into the rod side oil chamber of the boom cylinder 7 and of the hydraulic oil discharged from the main pump 14R flowing into the rod side oil chamber of the arm cylinder 8. In other words, FIG. 12 illustrates a state in which the boom 4 is driven in the downward direction, and the arm 5 is driven in the opening direction. Here, the arm cylinder rod side oil passage C2 is also called a "first oil passage" as an oil passage that supplies the hydraulic oil discharged from the main pump 14R to a hydraulic actuator of the drive object, that is to say, as the first oil passage that supplies the hydraulic oil to the hydraulic actuator of the drive object.

In addition, the pressure of the boom cylinder bottom side oil passage C1 detected by the boom cylinder pressure sensor S1, that is, the pressure Pb of the hydraulic oil in the bottom side oil chamber of the boom cylinder 7, is higher than a pressure of the arm cylinder rod side oil passage C2 detected by the arm cylinder pressure sensor S2, that is, the pressure (Pa+TH1) obtained by adding the pressure amount TH1 to the pressure Pa of the hydraulic oil in the rod side oil chamber of the arm cylinder 8.

In such a state, the controller 30 outputs a predetermined control, signal to the inverter 18C, and causes the hydraulic pump-motor 310 to function as the hydraulic motor and the motor generator 300 to perform the regenerative operation. Power generation capacity (rotational load) of the motor generator 300 at this time is, for example, determined based on a difference between the pressure Pb and the pressure Pa (Pb−Pa), and is determined so as to increase as the difference increases. Moreover, the pressure of the hydraulic oil that the hydraulic pump-motor 310 discharges is adjusted by increasing or decreasing the power generation capacity (rotational load) of the motor generator 300, and is adjusted so that the pressure becomes the pressure (Pa+TH1) obtained by adding the pressure amount TH1 to the pressure Pa.

Furthermore, the controller 30 outputs a control signal to the first electromagnetic valve 321, and switches the valve position thereof to a third valve position 321C. In addition, the controller outputs a control signal to the second electromagnetic valve 322, and switches the valve position thereof to the first valve position 322A. As a result, the hydraulic oil that the hydraulic pump-motor 310 discharges reaches the arm cylinder rod side oil passage C2 (first oil passage) through the first electromagnetic valve 321, the second electromagnetic valve 322, and the oil passage C3, merges into the hydraulic oil that the main pump 14R discharges, and flows into the rod side oil chamber of the arm cylinder 8. Here, an oil passage connecting the hydraulic pump-motor 310 with the arm cylinder rod side oil passage C2 (which includes the C3) is also called a "second oil passage" as an oil passage that supplies the hydraulic oil supplied from the hydraulic pump-motor 310 to a hydraulic actuator of the drive object, that is to say, as the second oil passage that supplies the hydraulic oil to the hydraulic actuator of the drive object.

In addition, the controller 30 adjusts the discharge rate of the main pump 14R by outputting a control signal to the regulator 14R, and for example, causes the flow rate of the hydraulic oil flowing from the main pump 14R to the rod side oil chamber of the arm cylinder 3 to be reduced. This aims to reduce the flow rate of the main pump 14R without slowing down the movement of the arm 5, and to reduce the pressure loss in the control valve 17, Moreover, the controller 30 may reduce or zero the flow rate of the hydraulic oil flowing from the main pump 14R to the rod side oil chamber of the arm cylinder 8 by controlling the flow rate control valve for arm 17A that is one of the control valves 17. This aims to be able to supply the hydraulic oil discharged from, the main pump 14R to another hydraulic actuator without slowing down the movement of the arm 5. Here, when the flow rate of the hydraulic oil flowing from the main pump 14R to the rod side oil chamber of the arm cylinder 8 is reduced, only the hydraulic oil discharged from the hydraulic pump-motor 310 is supplied to the rod side oil chamber of the arm cylinder 8. Furthermore, the controller 30 may supply the hydraulic oil discharged from the hydraulic pump-motor 310 to the rod side oil chamber of the arm cylinder 8 without reducing the flow rate of the hydraulic oil flowing from the main pump 14R to the rod side oil chamber of the arm cylinder 8. This aims to compensate for lack of the discharge rate of the main pump 14R, or to increase the moving speed of the arm 5.

In this manner, the fluid communication circuit 320 causes the hydraulic oil discharged from the hydraulic pump-motor 310 to flow info the rod side oil chamber of the arm cylinder 8 in the sixth drive mode in which the boom 4 is driven in the downward direction; the arm 5 is driven in the opening direction; and the pressure Pb becomes the pressure (Pa+TH1) or higher.

Here, the oil passage C3 may merge into an oil passage that connects the bottom side oil chamber of the arm cylinder 8 with the control valve 17. In this case, the hydraulic oil that the hydraulic pump-motor 310 discharges flows into the bottom side oil chamber of the arm cylinder 8, and is used to close the arm 5.

Next, a description is given below of a state of the fluid communication circuit 320 in a seventh drive mode, with reference to FIG. 13.

FIG. 13 illustrates a state of the hydraulic oil discharged from the main pimp 14R flowing into the rod side oil chamber of the boom cylinder 7 and the hydraulic oil discharged from the main pump 14R flowing into the bottom side oil chamber of the arm cylinder 8. In other words, FIG. 13 illustrates a state in which the boom 4 is driven in the downward direction and the arm 5 is driven in the closing direction. Here, the first oil passage at this time, that is to say, the oil passage that supplies the hydraulic oil discharged from the main pump 14R to a hydraulic actuator of the drive object, becomes an arm cylinder bottom side oil passage C2*a* that connects the bottom side oil chamber of the arm cylinder 8 with the control valve 17.

In addition, a pressure defected by the boom cylinder pressure sensor S1, that is, the pressure Pb of the hydraulic oil in the bottom side oil chamber: of the boom cylinder 7, is lower than a pressure of an arm cylinder bottom side oil chamber C2*a* detected by an arm cylinder pressure sensor S2*a*, that is, a pressure (Paa+TH1) obtained by adding the pressure amount TH1 to a pressure Paa of the hydraulic oil in the bottom side oil chamber of the arm cylinder 8.

In such a state, the controller 30 outputs a predetermined control signal to the inverter 18C, and causes the motor generator 300 to per form power running and the hydraulic pump-motor 310 to function as the hydraulic pump 310. Rotary torque of the motor generator 300 at this time (torque to maintain a predetermined revolving speed), for example, varies depending on the magnitude of the pressure Paa and the difference between the pressure Pb and the pressure Paa (Paa−Pb), and becomes higher as the pressure Paa is higher or as the difference (Paa−Pb) is greater. Furthermore, the pressure of the hydraulic oil that the hydraulic pump-motor 310 discharges is adjusted by increasing or decreasing the revolving speed of the motor generator 300, and is adjusted so that the pressure of the hydraulic oil becomes the pressure (Paa+TH1) obtained by adding the pressure amount TH1 to the pressure Paa.

In addition, the controller 30 outputs a control signal to the first electromagnetic valve 321, and switches over the valve position thereof to the third valve position 321C. Moreover, the controller 30 outputs a control signal to the second electromagnetic valve 322, and switches over the valve position thereof to the first valve position 322A. As a result, the hydraulic oil that the hydraulic pump-motor 310 discharges reaches the arm cylinder bottom side oil passage Ca2 (first oil passage) through the first electromagnetic valve 321, the second-electromagnetic valve 322, and the oil passage C3, merges into the hydraulic oil discharged from the main pump 14R, and flows into the bottom side oil passage of the arm cylinder 8. Here, a second oil passage at this time, that is to say, an oil passage that supplies the hydraulic oil discharged from the hydraulic pump-motor 310 to a hydraulic actuator of the drive object becomes an oil passage that connects the hydraulic pump-motor 310 to the arm cylinder bottom side oil passage C2*a* (which includes the oil passage C3).

Moreover, the controller 30 adjusts the flow rate of the main pump 14R by output ting a control signal to the regulator 14RA, and reduces the flow rate of the hydraulic oil flowing from, the main pump 14R to the bottom side oil chamber of the arm cylinder 8, for example, by the flow rate of the hydraulic oil that the hydraulic pump-motor 310 discharges. This aims to reduce the discharge rate of the main pump 14R without slowing down the movement of the arm 5, and to reduce the pressure loss at the control valve 17. Furthermore, the controller 30 may reduce or zero the flow rate of the hydraulic oil flowing from, the main pump 14R to the bottom side oil chamber of the arm cylinder 8 by controlling the flow rate control valve 17A that is one of the control valves 17. This aims to be able to supply the hydraulic oil that the main pump 14R discharges to another hydraulic actuator without slowing down the movement of the arm 5. Here, when the flow rate of the hydraulic oil flowing from the main pump 14R to the bottom side oil chamber of the arm cylinder S is reduced, only the hydraulic oil that the hydraulic pump-motor 310 discharges is supplied to the bottom side oil chamber of the arm cylinder 8. In addition, the controller 30 may supply the hydraulic oil that the hydraulic pump-motor 310 discharges to the bottom side oil chamber of the arm cylinder 8 without reducing the flow rate of the hydraulic oil flowing from the main pump 14R to the bottom side oil chamber of the arm cylinder 3. This aims to compensate for lack of the discharge rate of the main pump 14R, or to increase the moving speed of the arm 5.

In this manner, the fluid communication circuit 320 causes the hydraulic oil that the hydraulic pump-motor 310 discharges to flow into the bottom side oil chamber of the arm cylinder 8 in the seventh drive mode in which the boom 4 is driven in the downward direction; the arm 5 is driven in the closing direction; and the pressure Pb is lower than the pressure (Pa+Th1).

Here, the oil passage C3 may merge into an oil passage that connects the rod side oil chamber of the arm cylinder 8 with the control valve 17. In this case, the hydraulic oil that the hydraulic pump-motor 310 discharges flows info the rod side oil chamber of the arm cylinder 8 and is used to open the arm 5.

Next, a description is given below of a state of the fluid communication circuit 320 in an eighth drive mode.

FIG. 14 illustrates a state of the hydraulic oil discharged from the main pump 14L flowing into the rod side oil chamber of the boom cylinder 7 and of the hydraulic oil not being supplied to the arm cylinder 8. In other words, FIG. 14 illustrates a state in which the boom 4 is driven in the downward direction and the arm 5 is not driven.

In such a state, the controller 30 outputs a predetermined control signal to the inverter 18C, and causes the hydraulic pump-motor 310 to function as the hydraulic motor and the motor generator 300 to perform the regenerative operation.

In addition, the controller 30 outputs a control signal to the first electromagnetic valve 321, and switches over the valve position thereof to the third valve position 321C. Moreover, the controller 30 outputs a control signal to the second electromagnetic valve 322, and switches over the valve position thereof to the second valve position 322B. As a result, the hydraulic oil that the hydraulic pump-motor 310 discharges is discharged to the hydraulic oil tank through the first electromagnetic valve 321 and the second electromagnetic valve 322.

In this way, the fluid communication circuit 320 causes the hydraulic oil that the hydraulic pump-motor 310 discharges to discharge to the hydraulic oil tank in the eighth drive mode in which the boom 4 is driven in the downward direction and the arm 5 is not driven.

Next, a description is given below of another state of the fluid communication circuit 320 in the sixth drive mode.

Figure 15:
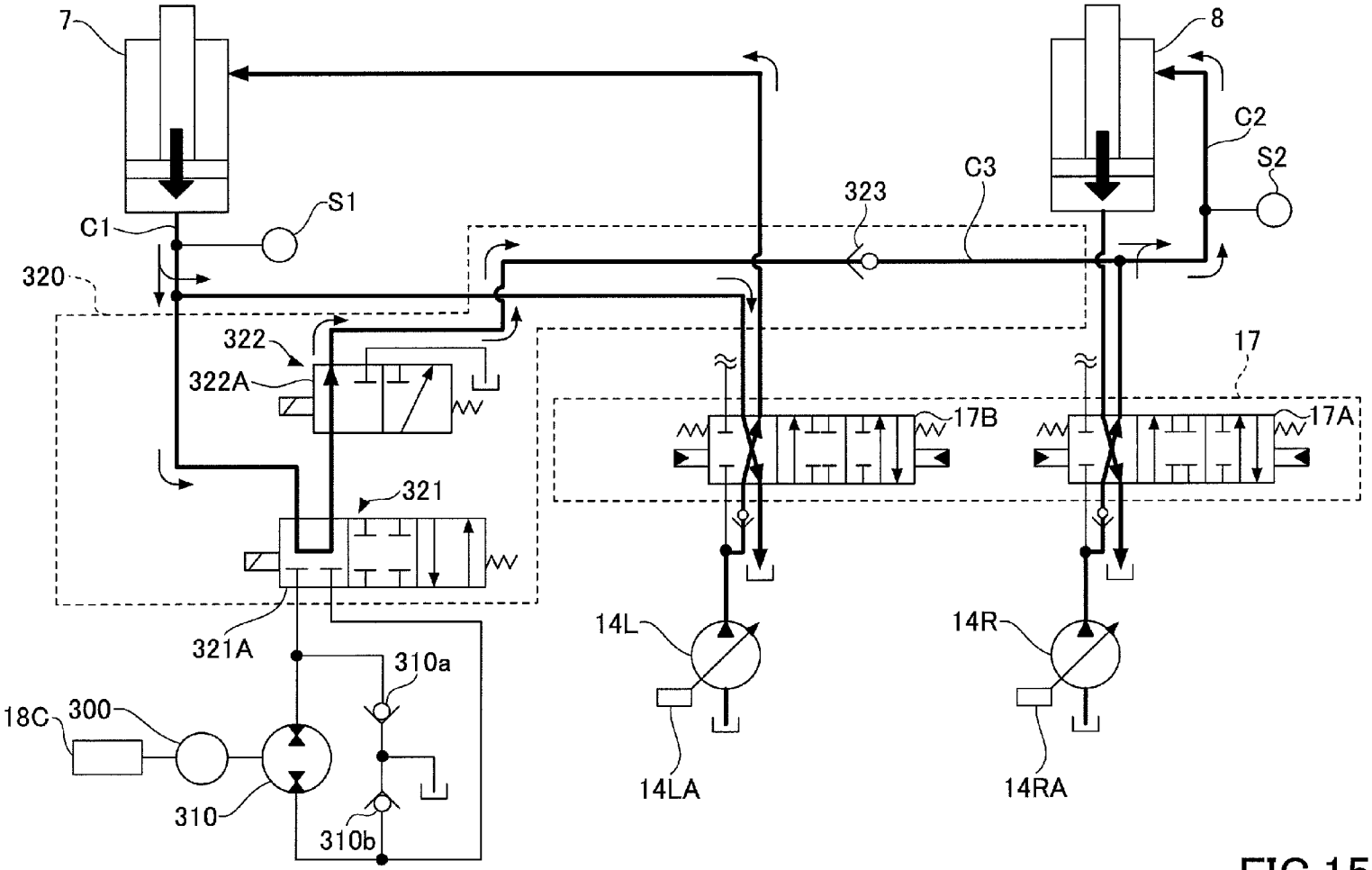
FIG. 15 is a drawing illustrating another state of a fluid communication circuit of a hybrid type shovel in a sixth drive mode according to an embodiment of the present invention.

FIG. 15 illustrates a state of the hydraulic oil discharged front the main pump 14L flowing into the rod side oil chamber of the boom cylinder 7 and of the hydraulic oil discharged from the main pump 14R flowing into the rod side oil chamber of the arm cylinder 8, as well as FIG. 12. In other words, FIG. 15 illustrates a state in which the boom 4 is driven in the downward direction and the arts 5 is driven in the opening direction.

Moreover, a pressure of the boom cylinder bottom side oil passage C1 detected by the boom cylinder pressure sensor S1, that is, the pressure Pb of the hydraulic oil in the bottom side oil chamber of the boom cylinder 7, is higher than a pressure of the arm cylinder rod side oil passage C2 detected by the arm cylinder pressure sensor S2, that is, the pressure (Pa+TH1) obtained by adding the pressure amount TH1 to the pressure Pa of the hydraulic oil in the rod side oil chamber of the arm cylinder 8.

In such a state, the controller 30 outputs a control signal to the first electromagnetic valve 321, and switches over the valve position thereof to the first valve position 321A. Moreover, the controller 30 outputs a control signal to the second electromagnetic valve 322, and switches over the valve position thereof to the first valve position 322A. As a result, the hydraulic pump-motor 310 is shut off from the fluid communication circuit 320, and a part or ail of the hydraulic oil flowing out of the bottom side oil chamber of the boom cylinder 7 reaches the arm cylinder rod side oil passage C2 (first oil passage) through, the first electromagnetic valve 321, the second electromagnetic valve 322, and the oil passage (33, merges into the hydraulic oil discharged from the main pump 14R, and flows into the rod side oil chamber of the arm cylinder 8.

Furthermore, the controller 30 adjusts the discharge rate of the main pump 14R by outputting a control signal to the regulator 14RA, and causes the flow rate of the hydraulic oil flowing from the main pump 14R to the rod side oil chamber of the arm cylinder 3 to be reduced, for example, by the flow rate of the hydraulic oil flowing out of the bottom side oil chamber of the boom cylinder 7 and flowing into the rod side oil chamber of the arm cylinder 8. This aims to reduce the discharge rare of the main pump 14R without slowing down the movement of the arm 5, and to reduce the pressure loss at the control valve 17. Moreover, the controller 30 may reduce or zero the flow rate of the hydraulic oil flowing from the main pump 14R to the rod side oil chamber of the arm cylinder 8 by controlling the flow rate control valve 17A that is one of the control valves 17. This aims to be able to supply the hydraulic oil discharged from the main pump 14R to another hydraulic actuator without slowing down the movement of the arm 5. Here, when the flow rate of the hydraulic oil flowing from the main pump 14R to the rod side oil chamber of the arm cylinder 8 is zeroed, only the hydraulic oil flowing out of the bottom side oil chamber of the boom cylinder 7 is supplied to the rod side oil chamber of the arm cylinder 8. Furthermore, the controller 30 may supply the hydraulic oil flowing out of the bottom side oil chamber of the boom cylinder 7 to the rod side oil chamber of the arm cylinder 8 without reducing the flow rate of the hydraulic oil flowing from the bottom side oil chamber of the boom, cylinder 7 to the rod side oil chamber of the arm cylinder 8. This aims to compensate for lack of the discharge rate of the main pump 14R, or to increase the moving speed for the arm 5.

In this way, the fluid communication circuit 320 can cause the hydraulic oil flowing out of the bottom side oil chamber of the boom cylinder 7 to flow into the rod side oil chamber of the arm cylinder 8 without flowing through the hydraulic pump-motor 310 in the sixth drive mode in which the boom 4 is driven in the downward direction; the arm 5 is driven in the opening direction; and the pressure Pb is the pressure (Pa+TH1) or higher.

Here, the oil passage C3 may merge into an oil passage that connects the bottom side oil chamber of the arm cylinder 8 to the control valve 17. In this case, the hydraulic oil flowing out of the bottom side oil chamber of the boom cylinder 7 flows into the bottom side oil chamber of the arm cylinder 8 and is used to close the arm 5.

With the above structure, the hybrid type shovel according to the second, embodiment of the present invention causes the hydraulic pump-motor 310 to function as the hydraulic motor for regeneration during the sixth drive mode and the eighth drive mode, and to function as the hydraulic pump during the seventh drive mode. As a result, the hybrid type shovel can make good use of the hydraulic pump-motor 310 in various drive modes.

In addition, the hybrid type shovel according to the second embodiment of the present invention causes the hydraulic pump-motor 310 to function as the hydraulic pump in the seventh drive mode, increases the pressure of the hydraulic oil flowing out of the bottom side oil chamber of the boom cylinder 7, and supplies the hydraulic oil to the arm cylinder 8. As a result, the hybrid type shovel can supply the hydraulic oil flowing out of the boom cylinder 7 to the arm cylinder 8 even if the pressure Pa of the hydraulic oil in the arm cylinder 8 (supply destination) is higher than the pressure Pb of the hydraulic oil in the boom cylinder 7 (supply source). A case in which the supply source is the arm cylinder 8 and the supply destination is the arm cylinder 8 is similar to this.

Moreover, the hybrid type shovel, according to the second embodiment of the present invention causes the hydraulic oil discharged from the hydraulic pump-motor 310 to meet the hydraulic oil discharged from the main pump 14R between the hydraulic actuator of the drive object and the control valve 17 in the sixth drive mode and the seventh drive mode. As a result, the hybrid type shovel can efficiently supply the hydraulic oil discharged from the hydraulic pump-motor 310 to the hydraulic actuator of the drive object while avoiding the pressure loss caused at the control valve 17.

As discussed above, according to embodiments of the present invention, there is provided a shovel and a method of controlling the shovel that can make better use of the hydraulic motor for regeneration.

All examples recited herein are intended for pedagogical purposes to aid the reader in understanding the invention and the concepts contributed by the inventor to furthering the art, and are to be construed, as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, although the hydraulic pump-motor 310 function as the hydraulic motor for boom regeneration in the first and the second embodiment, the hydraulic pump-motor 310 may function as the hydraulic motor for arm regeneration or the hydraulic motor for bucket regeneration additionally or alternately.

Moreover, the first electromagnetic valve 321 and the second, electromagnetic valve 322 are configured to be the independent two spool valves in the first and second embodiments, but may foe configured, to be one spool valve.

Furthermore, the fluid communication circuit 320 is applied to the hybrid type shovel mounting two of the main pumps 14L and 14R in the first and second embodiments, but may be applied to a hybrid type shovel mounting a single main pump 14.

In addition, the fluid communication circuit 320 is applied to the hybrid type shovel including the motor generator for revolution 21 in the first and second embodiments, but may be applied to a shovel including a hydraulic motor for revolution. In this case, the hydraulic oil that the hydraulic pump-motor 310 discharges may be supplied to the hydraulic motor for revolution.

What is claimed is:

1. A shovel, comprising:

a plurality of hydraulic actuators driven by using hydraulic oil and including a first hydraulic actuator and a second hydraulic actuator, the first hydraulic actuator and the second hydraulic actuator being driven by causing the hydraulic oil to flow thereinto and therefrom;

a first pressure detector configured to detect a first pressure of the hydraulic oil flowing out of the first hydraulic actuator;

a second pressure detector configured to detect a second pressure of the hydraulic oil in the second hydraulic actuator;

a main pump;

a hydraulic pump-motor configured to function as a hydraulic motor by using the hydraulic oil flowing out of the first hydraulic actuator upon detecting that the first pressure detected by the first pressure detector is higher than or equal to a predetermined threshold pressure that is higher than the second pressure detected by the second pressure detector, and configured to function as a hydraulic pump upon detecting that the first pressure is lower than the predetermined threshold pressure;

a control valve configured to control a flow of the hydraulic oil in the plurality of hydraulic actuators;

a first oil passage to connect the main pump with the second hydraulic actuator through the control valve; and a second oil passage to connect the hydraulic pump-motor with the second hydraulic actuator, the second oil passage meeting the first oil passage between the control valve and the second actuator, wherein the hydraulic pump-motor suctions the hydraulic oil flowing out of the first hydraulic actuator and discharges the hydraulic oil to the second hydraulic actuator.

2. The shovel of claim 1, further comprising:

a third oil passage to connect the first hydraulic actuator to the hydraulic pump-motor; and an electromagnetic valve arranged in the third oil passage, the electromagnetic valve being opened to communicate the first hydraulic actuator with the hydraulic pump-motor in driving the first hydraulic actuator.

3. The shovel of claim 1, wherein the first hydraulic actuator is a boom cylinder configured to drive a boom, and the hydraulic pump-motor functions as the hydraulic motor by using the hydraulic oil flowing out of the boom cylinder in lowering the boom.

4. The shovel of claim 1, wherein the first hydraulic actuator is a boom cylinder configured to drive a boom, and the hydraulic pump-motor functions as the hydraulic pump to supply the hydraulic oil to the boom cylinder in lifting the boom.

5. The shovel of claim 1, wherein the first hydraulic actuator is a boom cylinder configured to drive a boom, and the hydraulic pump-motor functions as the hydraulic pump to supply the hydraulic oil, when the boom is not driven and at least one work element other than the boom is driven, to at least one of the plurality of hydraulic actuators configured to drive the at least one work element.

6. The shovel of claim 1, wherein the hydraulic pump-motor that functions as the hydraulic pump increases the first pressure of the hydraulic oil flowing out of the first hydraulic actuator and discharges the hydraulic oil at a third pressure higher than the second pressure in the second hydraulic actuator.

7. The shovel of claim 6, wherein the third pressure is the predetermined threshold pressure.

8. The shovel of claim 1, wherein the hydraulic pump-motor that functions as the hydraulic motor decreases the first pressure of the hydraulic oil flowing out of the first hydraulic actuator and discharges the hydraulic oil at a third pressure lower than the first pressure when the first pressure of the hydraulic oil flowing out of the first hydraulic actuator is higher than the second pressure of the hydraulic oil in the second hydraulic actuator by a predetermined pressure amount or higher.

9. The shovel of claim 8, wherein the third pressure is the predetermined threshold pressure.

10. The shovel of claim 1, wherein an oil passage capable of directly supplying the hydraulic oil flowing out of the first hydraulic actuator to the second hydraulic actuator is provided between the first hydraulic actuator and the second hydraulic actuator.

11. The shovel of claim 1, wherein the first hydraulic actuator is a boom cylinder, and the second hydraulic actuator is an arm cylinder.

12. The shovel of claim 1, wherein the first hydraulic actuator is an arm cylinder, and the second hydraulic actuator is a boom cylinder.

13. The shovel of claim 1, further comprising:

a hydraulic oil tank storing the hydraulic oil therein, wherein part of the hydraulic oil flowing out of the first hydraulic actuator is caused to flow into the hydraulic pump-motor, and the other part of the hydraulic oil flowing out of the first hydraulic actuator is caused to discharge to the hydraulic oil tank through the control valve.

14. A method of controlling a shovel, the shovel including, a plurality of hydraulic actuators including a first hydraulic actuator and a second hydraulic actuator;

a main pump;

a hydraulic pump-motor configured to function as a hydraulic motor by using hydraulic oil flowing out of the first hydraulic actuator, and configured to function as a hydraulic pump;

a control valve configured to control a flow of the hydraulic oil in the plurality of hydraulic actuators;

a first oil passage to connect the main pump with the second hydraulic actuator through the control valve; and a second oil passage to connect the hydraulic pump-motor with the second hydraulic actuator, the method, comprising steps of:

causing the hydraulic oil flowing through the second oil passage to merge into the hydraulic oil flowing through the first oil passage between the control valve and the second actuator;

detecting a first pressure of the hydraulic oil flowing out of the first hydraulic actuator;

detecting a second pressure of the hydraulic oil in the second hydraulic actuator;

causing the hydraulic pump-motor to function as the hydraulic motor by using the hydraulic oil flowing out of the first hydraulic actuator upon detecting that the detected first pressure is higher than or equal to a predetermined threshold pressure that is higher than the detected second pressure; and causing the hydraulic pump-motor to function as the hydraulic pump upon detecting that the first pressure is lower than the predetermined threshold pressure, wherein the hydraulic pump-motor suctions the hydraulic oil from the first hydraulic oil actuator and discharges the hydraulic oil to the second hydraulic actuator.

15. The method of claim 14, wherein an electromagnetic valve arranged in a third oil passage connecting the first hydraulic actuator to the hydraulic pump-motor is opened to communicate the first hydraulic actuator with the hydraulic pump-motor when driving the first hydraulic actuator.

16. The method of claim 14, wherein the hydraulic pump-motor increases the first pressure of the hydraulic oil flowing out of the first hydraulic actuator and discharges the hydraulic oil at a third pressure higher than the second pressure of the hydraulic oil in the second hydraulic actuator.

17. A shovel, comprising:

a plurality of hydraulic actuators driven by using hydraulic oil and including a first hydraulic actuator and a second hydraulic actuator, the first hydraulic actuator and the second hydraulic actuator being driven by causing the hydraulic oil to flow thereinto and therefrom;

a first pressure detector configured to detect a first pressure of the hydraulic oil flowing out of the first hydraulic actuator;

a second pressure detector configured to detect a second pressure of the hydraulic oil in the second hydraulic actuator;

a main pump;

a hydraulic pump-motor configured to function as a hydraulic motor by using the hydraulic oil flowing out of the first hydraulic actuator upon detecting that the first pressure detected by the first pressure detector is higher than or equal to a predetermined threshold pressure that is higher than the second pressure detected by the second pressure detector, and configured to function as a hydraulic pump upon detecting that the first pressure is lower than the predetermined threshold pressure;

a control valve configured to control a flow of the hydraulic oil in the plurality of hydraulic actuators;

a first oil passage to connect the main pump with the second hydraulic actuator through the control valve;

a second oil passage to connect the hydraulic pump-motor with the second hydraulic actuator, the second oil passage meeting the first oil passage between the control valve and the second actuator;

a suction port provided in the pump-motor;

a discharge port provided in the pump-motor;

a hydraulic oil tank storing the hydraulic oil therein; and one or more valves configured be able to switch among a first state by which suction port of the hydraulic pump-motor is in communication with the first hydraulic actuator and the discharge port of the hydraulic pump-motor is in communication with the second hydraulic actuator, a second state by which suction port of the hydraulic pump-motor is in communication with the first hydraulic actuator and the discharge port of the hydraulic pump-motor is in communication with the hydraulic oil tank, and a third state by which the suction port of the hydraulic pump-motor is shut off from the first hydraulic actuator and the first hydraulic actuator is in communication with the second hydraulic actuator.

18. The shove of claim 17, wherein the one or more valves includes a first valve configured to switch between a connected status wherein the first hydraulic actuator and the hydraulic pump-motor are connected and a disconnected status between the first hydraulic actuator and the hydraulic pump-motor are disconnected, a second valve configured to switch between a connected status wherein the second hydraulic actuator and the hydraulic pump-motor are connected and a disconnected status between the first hydraulic actuator and the hydraulic pump-motor are disconnected, and a third valve configured to switch between supplying the hydraulic oil flowing out of the first hydraulic actuator to second hydraulic actuator and supplying the hydraulic oil flowing out of the first hydraulic actuator to the hydraulic tank.

* * * * *